United States Patent [19]

Hannauer et al.

[11] 4,061,904

[45] Dec. 6, 1977

[54] VARIABLE ANALOG FUNCTION GENERATOR

[75] Inventors: George Hannauer, E. Windsor; Abhaya Asthana, Long Branch, both of N.J.

[73] Assignee: Electronic Associates, Inc., Long Branch, N.J.

[21] Appl. No.: 663,297

[22] Filed: Mar. 3, 1976

[51] Int. Cl.[2] ..... G06J 1/00; G06G 7/28

[52] U.S. Cl. ..... 235/150.53; 364/852

[58] Field of Search ..... 235/150.53, 150.5, 197, 235/152, 156; 340/172.5

[56] References Cited

U.S. PATENT DOCUMENTS

| | | | |
|---|---|---|---|
| 3,373,273 | 3/1968 | Schubert | 235/150.53 X |
| 3,513,301 | 5/1970 | Howe | 235/150.53 |
| 3,557,347 | 1/1971 | Robertson | 235/150.53 |
| 3,662,160 | 5/1972 | Hoppes | 235/150.53 |
| 3,678,258 | 7/1972 | Patmore et al. | 235/150.53 |

*Primary Examiner*—Joseph F. Ruggiero
*Attorney, Agent, or Firm*—Frailey and Ratner

[57] ABSTRACT

A variable analog function generator which is independent of an external computer during the time that it generates at least one predetermined output function of at least one input variable. The output function is expressed in terms of hybrid variables each having an analog portion and a digital portion. The function generator has a first dedicated memory which is loaded during set up time with data related to breakpoints defining the input variable. A second dedicated memory is loaded during set up time with tables of values defining the digital portion. During function generation, the analog portions are generated in response to (1) the input variable and (2) the data related to the breakpoints which is accessed in parallel from the first dedicated memory. The output function is generated in response to (1) the analog portions and (2) the tables of values accessed from the second dedicated memory.

24 Claims, 19 Drawing Figures

ODD

EVEN
(1-ΔX)[F(Xi)]

F(X)=ΔX[F(Xi+1)]+
(1-ΔX)[F(Xi)]

TABLE 1

250b
MWR*
F-3, F-5, F-4
INCR*
F-3, F-4
250a
WB00*-WB11*
F-3
250
250c
WB12*-WB15*
F-5
RUN F
CLRADR*
F-3, F-4
253
MONO
251b
RUN*
F-3, F-4, F-5
251a
F/F
254
12
MONO 200 MS
MONO 200 MS
4 X 16 LATCHES
252
MEMORY SELECT LATCH
256
7
SELECT
F/F
8 INPUT NAND GATE
EXC. OK
DLOR-DLO5R
DL09R-DL15R
DLOR-15R
16
LOADR
SELR
DLO-15
16
LOAD
SEL
11
DIGITAL COMPUTER
ON LINE

WEIGHTING FUNCTION

WEIGHTING FUNCTION

VARIABLE ANALOG FUNCTION GENERATOR

TABLE OF CONTENTS

1. ABSTRACT
2. BACKGROUND OF THE INVENTION
   A. Field of the Invention
   B. Prior Art
3. SUMMARY OF THE INVENTION
4. BRIEF DESCRIPTION OF THE DRAWINGS
5. SYMBOLS AND DEFINITIONS
6. CONCEPTS
7. GENERAL OPERATION
8. DETAILED DESCRIPTION OF BREAKPOINT DETECTION AND COMPARATOR
9. WEIGHTING FUNCTION CIRCUIT
10. ANALOG INTERPOLATION UNIT
   A. Function of Two or More Variables
11. CONTROL UNIT
12. TABLE OF COMPONENTS
13. COMPUTER PROGRAM FOR SET UP

BACKGROUND OF THE INVENTION

A. Field of the Invention

This invention relates to the field of the art of function generators.

B. Prior Art

Function generators have in the past used differing types of analog techniques such as diode function generation. While this technique has been used in the generation of single variable functions, in multivariable or multivariant applications, diode function generators have been limited as they have required complex circuitry. For example, sixteen diode function generators have been used to produce one two-variable function which not only involves much circuitry but also requires a lengthy set up time with a narrow range of types of functions. A slower but less costly technique has been in the use of tapped servo potentiometers in which there has been performed interpolation among up to seventeen functions of one variable. However, servo motor multivariant function generators have been substantially limited because of their speed, their long set up time and their lack of flexibility in programming.

Accordingly, digital and hybrid analog-digital approaches have been suggested in the literature by W. E. Chapelle, "Hybrid Techniques for Analog Function Generation," AFIPS Conference Proceedings, Vol. 23, 1963, pp. 213–227 and Arthur I. Rubin, "Hybrid Techniques for Generation of Arbitrary Functions," Simulation, December 1966, pp. 293–308. However, both of the foregong techniques have required a dedicated digital computer memory and control to be used during the entire phase of operation of the generation of the multivariant functions. In view of the large memory needed by the control and the storage of the functions for the function generator and as a result of the high speed required, such dedicated memory and control has been extremely costly.

SUMMARY OF THE INVENTION

A variable analog function generator which is independent of an external data source and control during the time it generates at least one predetermined output function of at least one input variable. The output function is expressed in terms of hybrid variables each having an analog portion and a digital portion. A first dedicated memory means is stored with data related to the breakpoints which define the input variable. Second dedicated memory means is stored with tables of values defining the digital portion of the hybrid variables. The analog portions are generated independent of the external data source and control in response to (1) the input variable and (2) the data related to the breakpoints accessed in parallel from the first dedicated memory means. The output function is generated also independent of the external data source and control in response to (1) the analog portions and (2) the tables of values accessed from the second dedicated memory means.

SYMBOLS AND DEFINITIONS $V$ = input variable $F(V)$ = output function $V_i$ = variable V at breakpoint $i$ $\Delta V_i$ = first differences of the variable V at breakpoint $i$ $X, Y, Z, W$ = multiple independent variable (multivariant) inputs $\Delta X$, $1-\Delta X$, $(1-\Delta X)(1-\Delta Y)$, $\Delta Z$, $\Delta W$, etc. = analog portions of the hybrid variables or weighting functions $F(X_i)$, $F(X_{i+1})$, $F(X_i, Y_j)$, $F(Z_k, W_l)$, etc. = digital portions of the hybrid variables $X_i, Y_j, Z_k, W_l$ = values of breakpoints $X, Y, Z, W$, respectively at breakpoints $i, j, k$ and $l$ $\Delta X_i, \Delta Y_j, \Delta Z_k, \Delta W_l$ = first differences for the variables $X, Y, Z, W$, respectively $F(X)$, $F(Y)$, $F(X, Y)$, etc. = output analog functions F-3, F-4, etc. = indicates that a conductor or cable is connected to a similarly identified conductor or cable in FIG. 3, FIG. 4, etc.

CONCEPTS

Figure 1A:
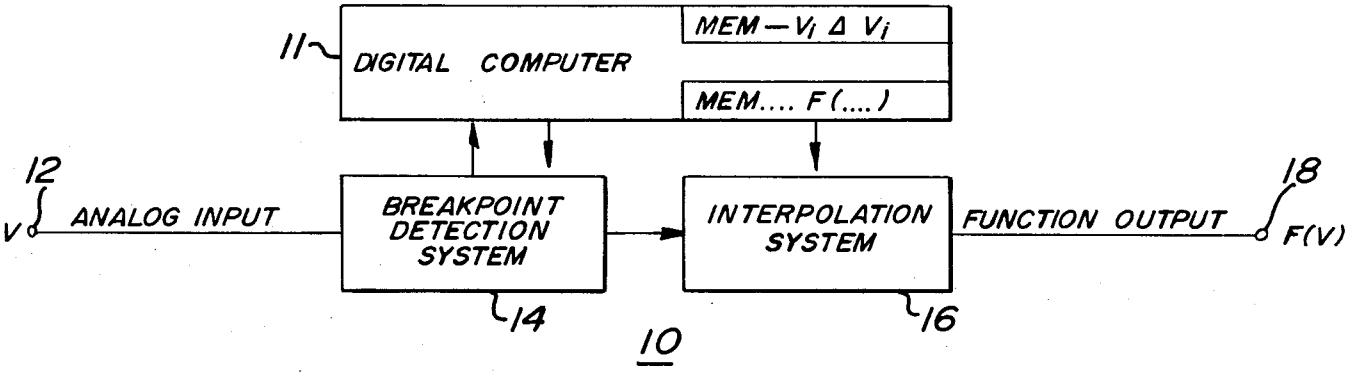
FIG. 1A PRIOR ART
FIG. 1A illustrates in basic block diagram form a multivariant function generator of the prior art.
Figure 1B:
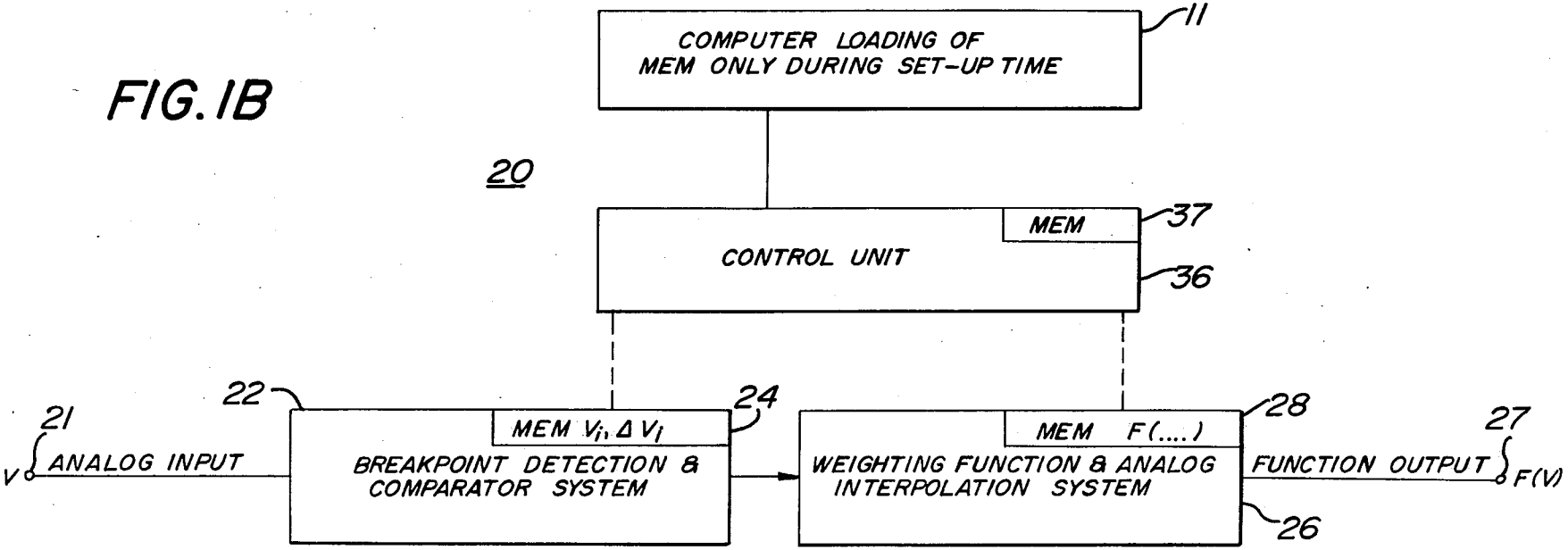
FIG. 1B illustrates in basic block diagram form a variable analog function generator system 20 embodying the invention.
Figure 1C:
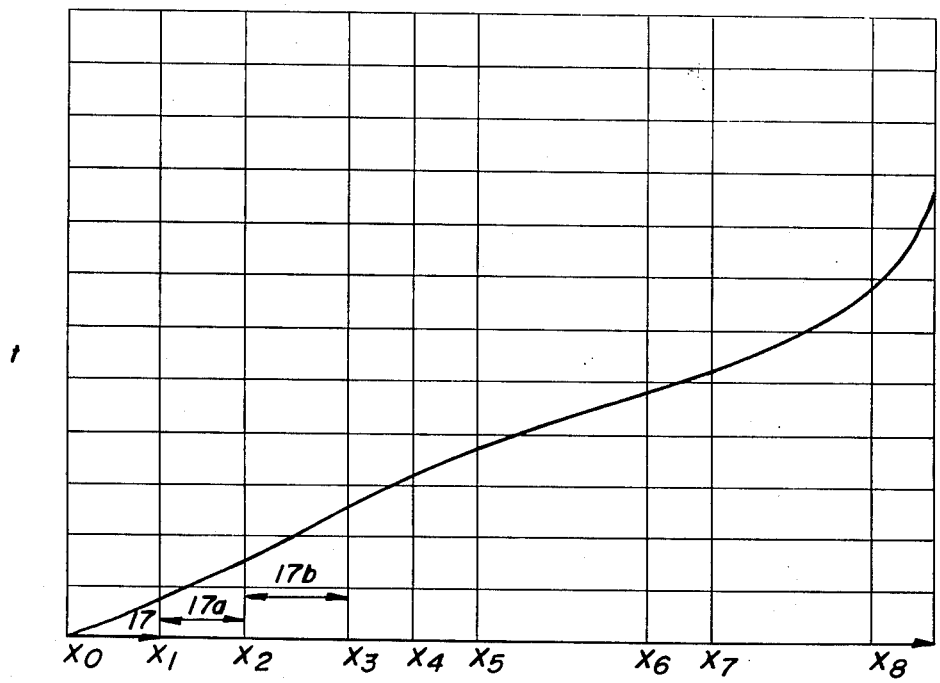
FIGS. 1C–G illustrate waveforms helpful in describing the concepts set forth in the disclosure.

FIG. 1C illustrates a single selected analog variable X which changes with respect to time. The difference in value between successive breakpoints is defined as a "first difference" and is indicated as 17, 17*a*, 17*b*, etc. The breakpoints for the desired variables may be calculated in a manner later to be described.

As described in the above cited articles by Rubin and Chapelle an analog output function of X may be defined as the sum of the product of two hybrid variables as follows.

$$F(X) = (1 - \Delta X)\, F(X_i) + \Delta X\, F(X_{i+1}) \text{ for } i = 0, 2, 4 \ldots \quad (1a)$$

$$\text{where } \Delta X = \frac{X - X_i}{X_{i+1} - X_i}$$

$$F(X) = (1 - \Delta X)\, F(X_{i+1}) + \Delta X\, F(X_i) \text{ for } i = 1, 3, 5 \ldots \quad (1b)$$

$$\text{where } \Delta X = \frac{X_{i+1} - X}{X_{i+1} - X_i}$$

In equations 1*a-b*, $1-\Delta X$ and $\Delta X$ comprise the analog portion of the hybrid variables (weighting functions) while $F(X_i)$ and $F(X_{i+1})$ comprises the digital portion. The analog portions may be represented by triangular waveforms shown in FIG. 1D where the solid line triangular portion representing $\Delta X$ is the complement of the dotted line triangular portion $1-\Delta X$. $\Delta X$ may be considered to represent the function X in an odd interval while $1-\Delta X$ may be considered to represent the function in an even interval. The digital portion of equation 1 represents predetermined values in accordance with the desired function for alternating or odd/even intervals of the triangular waveforms of FIG. 1D.

For example, the following table shows selected values of functions for even intervals and odd intervals.

Table I

| | |
|---|---|
| $F(X_6) = 1.0$ | $F(X_7) = 0.5$ |
| $F(X_4) = 1.5$ | $F(X_5) = 1.5$ |
| $F(X_2) = 1.0$ | $F(X_3) = 1.0$ |
| $F(X_0) = 0.5$ | $F(X_1) = 0.5$ |
| 61a | 61b |
| even (e) | odd (o) |

Figure 1D:
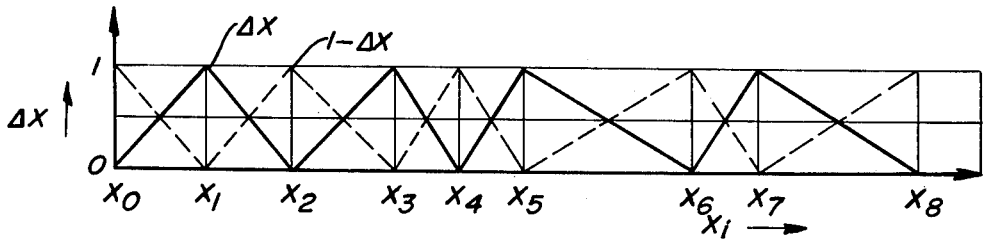
Figure 1E:
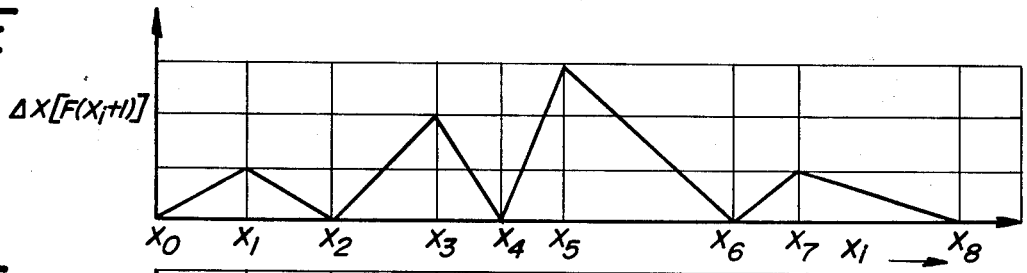
Figure 1F:
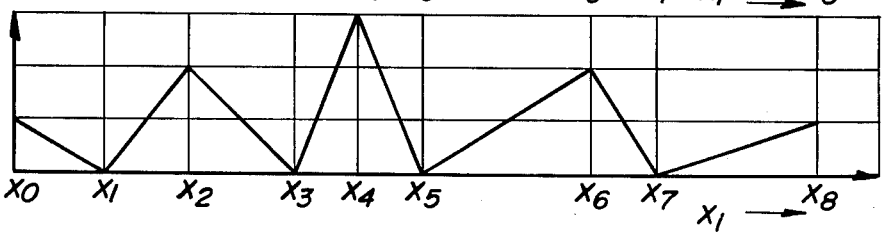

By multiplying each digital portion in Table 1 with the associated values of the triangular waveshapes for the odd and even intervals in FIG. 1D, there is produced the respective waveshapes shown in FIGS. 1E, 1F. The output function F(X) is provided in accordance with equation 1 by adding the values of FIGS. 1E, 1F to produce the waveform of FIG. 1G.

For a function of two variables, the analog function may be represented by $$\begin{aligned} F(X, Y) = {} & (1 - \Delta X)(1 - \Delta Y)\, F(X_i, Y_j) \\ & + (\Delta X)(1 - \Delta Y)\, F(X_{i+1}, Y_j) \\ & + (1 - \Delta X)(\Delta Y)\, F(X_i, Y_{j+1}) \\ & + (\Delta X)(\Delta Y)\, F(X_{i+1}, Y_{j+1}) \end{aligned} \quad (2)$$

-continued where $i = 0, 2, 4, \ldots$ and $j = 0, 2, 4, \ldots$

The analog portions of the hybrid variable or the weighting functions are represented by the terms $(1-\Delta X)$, $(1-\Delta Y)$, $(\Delta X)$, etc. The digital portions are represented by $F(X_i, Y_j)$, etc.

As in Table I, the digital portions of the function of two variables may be selected to have values $F(X_0, Y_0)$, $F(X_1, Y_0)$, etc. as follows.

Table II

| ADDRESS | | | | |
|---|---|---|---|---|
| 63 | $F(X_{14}, Y_{14})$ | $F(X_{15}, Y_{14})$ | $F(X_{14}, Y_{15})$ | $F(X_{15}, Y_{15})$ |
| | ⋮ | ⋮ | ⋮ | ⋮ |
| | $F(X_2, Y_{14})$ | $F(X_3, Y_{14})$ | $F(X_2, Y_{15})$ | $F(X_3, Y_{15})$ |
| | $F(X_0, Y_{14})$ | $F(X_1, Y_{14})$ | $F(X_0, Y_{15})$ | $F(X_1, Y_{15})$ |
| | ⋮ | ⋮ | ⋮ | ⋮ |
| 15 | $F(X_{14}, Y_2)$ | $F(X_{15}, Y_2)$ | $F(X_{14}, Y_3)$ | $F(X_{15}, Y_3)$ |
| | ⋮ | ⋮ | ⋮ | ⋮ |
| 10 | $F(X_4, Y_2)$ | $F(X_5, Y_2)$ | $F(X_4, Y_3)$ | $F(X_5, Y_3)$ |
| 9 | $F(X_2, Y_2)$ | $F(X_3, Y_2)$ | $F(X_2, Y_3)$ | $F(X_3, Y_3)$ |
| 8 | $F(X_0, Y_2)$ | $F(X_1, Y_2)$ | $F(X_0, Y_3)$ | $F(X_1, Y_3)$ |
| 7 | $F(X_{14}, Y_0)$ | $F(X_{15}, Y_0)$ | $F(X_{14}, Y_1)$ | $F(X_{15}, Y_1)$ |
| | ⋮ | ⋮ | ⋮ | ⋮ |
| 2 | $F(X_4, Y_0)$ | $F(X_5, Y_0$ | $F(X_4, Y_1)$ | $F(X_5, Y_1)$ |
| 1 | $F(X_2, Y_0)$ | $F(X_3, Y_0)$ | $F(X_2, Y_1)$ | $F(X_3, Y_1)$ |
| 0 | $F(X_0, Y_0)$ | $F(X_1, Y_0)$ | $F(X_0, Y_1)$ | $F(X_1, Y_1)$ |
| | 61a | 61b | 62a | 62b |
| | ee | oe | eo | oo |

For a function of three variables, the analog output function may be represented by $$\begin{aligned} F(X_i, Y_j, Z_k) = {} & (1 - \Delta X)(1 - \Delta Y)(1 - \Delta Z)\, F(X_i, Y_j, Z_k) \\ & + (\Delta X)(1 - \Delta Y)(1 - \Delta Z)\, F(X_{i+1}, Y_j, Z_k) \\ & + (1 - \Delta X)(\Delta Y)(1 - \Delta Z)\, F(X_i, Y_{j+1}, Z_k) \\ & + (\Delta X)(\Delta Y)(1 - \Delta Z)\, F(X_{i+1}, Y_{j+1}, Z_k) \\ & + (1 - \Delta X)(1 - \Delta Y)(\Delta Z)\, F(X_i, Y_j, Z_{k+1}) \\ & + (\Delta X)(1 - \Delta Y)(\Delta Z)\, F(X_{i+1}, Y_j, Z_{k+1}) \\ & + (1 - \Delta X)(\Delta Y)(\Delta Z)\, F(X_i, Y_{j+1}, Z_{k+1}) \\ & + (\Delta X)(\Delta Y)(\Delta Z)\, F(X_{i+1}, Y_{j+1}, Z_{k+1}) \end{aligned} \quad (3)$$

where $i = 0, 2, 4, \ldots,$ $j = 0, 2, 4, \ldots,$ and $k = 0, 2, 4, \ldots$

The digital portions of the hybrid variables may be selected to have the values set forth in the following.

Table III

| | | | | | | | | | | | | | | | | | | | | | | | |
|---|---|---|---|---|---|---|---|---|---|---|---|---|---|---|---|---|---|---|---|---|---|---|---|
| e | e | e | e | e | o | e | o | e | e | o | o | o | e | e | o | e | o | o | o | e | o | o | o |
| $Z_k$ | $Y_m$ | $X_n$ | $Z_k$ | $Y_m$ | $X_{n'}$ | $Z_k$ | $Y_{m'}$ | $X_n$ | $Z_k$ | $Y_{m'}$ | $X_{n'}$ | $Z_{k'}$ | $Y_m$ | $X_n$ | $Z_{k'}$ | $Y_m$ | $X_{n'}$ | $Z_{k'}$ | $Y_{m'}$ | $X_n$ | $Z_{k'}$ | $Y_{m'}$ | $X_{n'}$ |
| | | ⋮ | | | ⋮ | | | ⋮ | | | ⋮ | | | ⋮ | | | ⋮ | | | ⋮ | | | ⋮ |
| $Z_k$ | $Y_m$ | $X_0$ | $Z_k$ | $Y_m$ | $X_1$ | $Z_k$ | $Y_{m'}$ | $X_0$ | $Z_k$ | $Y_{m'}$ | $X_1$ | $Z_{k'}$ | $Y_m$ | $X_0$ | $Z_{k'}$ | $Y_m$ | $X_1$ | $Z_{k'}$ | $Y_{m'}$ | $X_o$ | $Z_{k'}$ | $Y_{m'}$ | $X_1$ |
| | | ⋮ | | | ⋮ | | | ⋮ | | | ⋮ | | | ⋮ | | | ⋮ | | | ⋮ | | | ⋮ |
| $Z_k$ | $Y_0$ | $X_n$ | $Z_k$ | $Y_0$ | $X_{n'}$ | $Z_k$ | $Y_1$ | $X_n$ | $Z_k$ | $Y_1$ | $X_{n'}$ | $Z_{k'}$ | $Y_0$ | $X_n$ | $Z_{k'}$ | $Y_0$ | $X_{n'}$ | $Z_{k'}$ | $Y_1$ | $X_n$ | $Z_{k'}$ | $Y_1$ | $X_{n'}$ |
| | | ⋮ | | | ⋮ | | | ⋮ | | | ⋮ | | | ⋮ | | | ⋮ | | | ⋮ | | | ⋮ |

Table III-continued

| e | e | e | e | e | o | e | o | e | e | o | o | o | e | e | o | e | o | o | o | e | o | o | o |
|---|---|---|---|---|---|---|---|---|---|---|---|---|---|---|---|---|---|---|---|---|---|---|---|
| $Z_k$ | $Y_0$ | $X_0$ | $Z_k$ | $Y_0$ | $X_1$ | $Z_k$ | $Y_1$ | $X_0$ | $Z_k$ | $Y_1$ | $X_1$ | $Z_{k'}$ | $Y_0$ | $X_0$ | $Z_{k'}$ | $Y_0$ | $X_1$ | $Z_{k'}$ | $Y_1$ | $X_0$ | $Z_{k'}$ | $Y_1$ | $X_1$ |
| $Z_2$ | $Y_m$ | $X_n$ | $Z_2$ | $Y_m$ | $X_{n'}$ | $Z_2$ | $Y_{m'}$ | $X_n$ | $Z_2$ | $Y_{m'}$ | $X_{n'}$ | $Z_3$ | $Y_m$ | $X_n$ | $Z_3$ | $Y_m$ | $X_{n'}$ | $Z_3$ | $Y_{m'}$ | $X_n$ | $Z_3$ | $Y_{m'}$ | $X_{n'}$ |
| $Z_2$ | $Y_m$ | $X_0$ | $Z_2$ | $Y_m$ | $X_1$ | $Z_2$ | $Y_{m'}$ | $X_0$ | $Z_2$ | $Y_{m'}$ | $X_1$ | $Z_3$ | $Y_m$ | $X_0$ | $Z_3$ | $Y_m$ | $X_1$ | $Z_3$ | $Y_{m'}$ | $X_0$ | $Z_3$ | $Y_{m'}$ | $X_1$ |
| $Z_2$ | $Y_0$ | $X_n$ | $Z_2$ | $Y_0$ | $X_{n'}$ | $Z_2$ | $Y_1$ | $X_n$ | $Z_2$ | $Y_1$ | $X_{n'}$ | $Z_3$ | $Y_0$ | $X_n$ | $Z_3$ | $Y_0$ | $X_{n'}$ | $Z_3$ | $Y_1$ | $X_n$ | $Z_3$ | $Y_1$ | $X_{n'}$ |
| $Z_2$ | $Y_0$ | $X_0$ | $Z_2$ | $Y_0$ | $X_1$ | $Z_2$ | $Y_1$ | $X_0$ | $Z_2$ | $Y_1$ | $X_1$ | $Z_3$ | $Y_0$ | $X_0$ | $Z_3$ | $Y_0$ | $X_1$ | $Z_3$ | $Y_1$ | $X_0$ | $Z_3$ | $Y_1$ | $X_1$ |
| $Z_0$ | $Y_m$ | $X_n$ | $Z_0$ | $Y_m$ | $X_{n'}$ | $Z_0$ | $Y_{m'}$ | $X_n$ | $Z_0$ | $Y_{m'}$ | $X_{n'}$ | $Z_1$ | $Y_m$ | $X_n$ | $Z_1$ | $Y_m$ | $X_{n'}$ | $Z_1$ | $Y_{m'}$ | $X_n$ | $Z_1$ | $Y_{m'}$ | $X_{n'}$ |
| $Z_0$ | $Y_m$ | $X_2$ | $Z_0$ | $Y_m$ | $X_3$ | $Z_0$ | $Y_{m'}$ | $X_2$ | $Z_0$ | $Y_{m'}$ | $X_3$ | $Z_1$ | $Y_m$ | $X_2$ | $Z_1$ | $Y_m$ | $X_3$ | $Z_1$ | $Y_{m'}$ | $X_2$ | $Z_1$ | $Y_{m'}$ | $X_3$ |
| $Z_0$ | $Y_m$ | $X_0$ | $Z_0$ | $Y_m$ | $X_1$ | $Z_0$ | $Y_{m'}$ | $X_0$ | $Z_0$ | $Y_{m'}$ | $X_1$ | $Z_1$ | $Y_m$ | $X_0$ | $Z_1$ | $Y_m$ | $X_1$ | $Z_1$ | $Y_{m'}$ | $X_0$ | $Z_1$ | $Y_{m'}$ | $X_1$ |
| $Z_0$ | $Y_2$ | $X_n$ | $Z_0$ | $Y_2$ | $X_{n'}$ | $Z_0$ | $Y_3$ | $X_n$ | $Z_0$ | $Y_3$ | $X_{n'}$ | $Z_1$ | $Y_2$ | $X_n$ | $Z_1$ | $Y_2$ | $X_{n'}$ | $Z_1$ | $Y_3$ | $X_n$ | $Z_1$ | $Y_3$ | $X_{n'}$ |
| $Z_0$ | $Y_2$ | $X_0$ | $Z_0$ | $Y_2$ | $X_1$ | $Z_0$ | $Y_3$ | $X_0$ | $Z_0$ | $Y_3$ | $X_1$ | $Z_1$ | $Y_2$ | $X_0$ | $Z_1$ | $Y_2$ | $X_1$ | $Z_1$ | $Y_3$ | $X_0$ | $Z_1$ | $Y_3$ | $X_1$ |
| $Z_0$ | $Y_0$ | $X_n$ | $Z_0$ | $Y_0$ | $X_{n'}$ | $Z_0$ | $Y_1$ | $X_n$ | $Z_0$ | $Y_1$ | $X_{n'}$ | $Z_1$ | $Y_0$ | $X_n$ | $Z_1$ | $Y_0$ | $X_{n'}$ | $Z_1$ | $Y_1$ | $X_n$ | $Z_1$ | $Y_1$ | $X_{n'}$ |
| $Z_0$ | $Y_0$ | $X_2$ | $Z_0$ | $Y_0$ | $X_3$ | $Z_0$ | $Y_1$ | $X_2$ | $Z_0$ | $Y_1$ | $X_3$ | $Z_1$ | $Y_0$ | $X_2$ | $Z_1$ | $Y_0$ | $X_3$ | $Z_1$ | $Y_1$ | $X_2$ | $Z_1$ | $Y_1$ | $X_3$ |
| $Z_0$ | $Y_0$ | $X_0$ | $Z_0$ | $Y_0$ | $X_1$ | $Z_0$ | $Y_1$ | $X_0$ | $Z_0$ | $Y_1$ | $X_1$ | $Z_1$ | $Y_0$ | $X_0$ | $Z_1$ | $Y_0$ | $X_1$ | $Z_1$ | $Y_1$ | $X_0$ | $Z_1$ | $Y_1$ | $X_1$ |
| | 61a | | | 61b | | | 62a | | | 62b | | | 63a | | | 63b | | | 64a | | | 64b | |

where
$n' = j - 1$
$k' = k - 1$
$m' = j - 1$
$m = j$
$n = i$

In general, a variable analog function generator effectively converts an analog variable into a hybrid variable and performs modifications on that hybrid variable. An external data source and control such as a digital computer is used in the conversion and modification of the hybrid variable to analog functions. Specifically, FIG. 1A generally shows a multivariant analog function generator 10 as described in the above cited articles by Chapelle and Rubin. This MVFG is a serial processor since each function is generated serially in a computer 11. An analog input is applied to input 12 and applied breakpoint detection system 14 which is effective to convert the analog voltage to analog portions of hybrid variables under the serial control of a digital computer 11. The analog portions of the hybrid variables are applied from system 14 to interpolation system 16 under the serial control of digital computer 11. Computer 11 provides a table of values corresponding to the digital portions of the hybrid variables in accordance with the output function to be generated by system 16. System 16 converts the analog portions and the tables of values into analog voltages at output 18.

GENERAL OPERATION

In the variable analog function generator 20 as shown in FIG. 1B, an analog input is applied to input 21 of breakpoint detection and comparator system 22. System 22 according to the invention has a dedicated integral memory 24 which stores the values of the breakpoints and the first differences. These values are computed for a given variable at set up time. An output of system 22 is applied to weighting function and analog interpolation system 26 which also has a dedicated integral dedicated memory 28. This memory stores a table of digital values corresponding to the digital portion of hybrid variable for the desired output function. A control unit 36 controls the sequence of loadings of memories 24, 28 during set up time and controls the sequence of accessing (using an integral extent memory 37) during the time of function generation. During set up time, control unit 36 controls the decoding and addressing of memories 24, 28 while computer 11 controls unit 36 and provides the data for loading dedicated memories 24, 28 and 37. After memories 24, 28 and 37 have been loaded during set up time, the function generation then takes place within systems 22 and 26 in parallel and simultaneously. The function generation is independent of the external data source and control of digital computer 11 but is under the effective control of control unit 36 using dedicated memories 24 and 28 and 37. As a result of the short access paths, parallel operation and independence of control from the external digital computer 11 system 20 has inherently fast operation.

Figure 2:
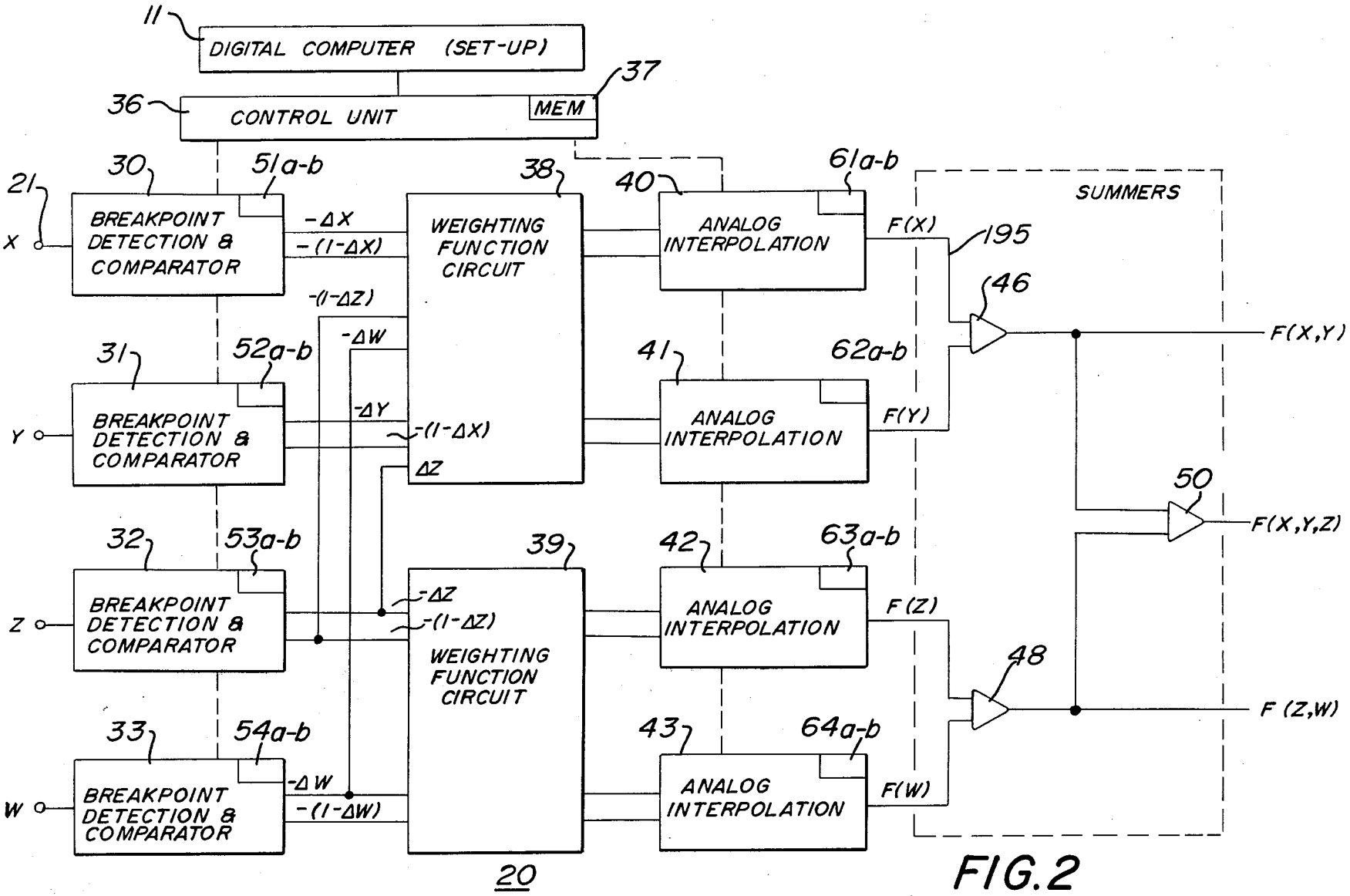
FIG. 2 is an intermediate block diagram of generator system 20.

FIG. 2 is an intermediate block diagram of system 20 shown in general block diagram form in FIG. 1B. System 22 of FIG. 1B comprises in FIG. 2, breakpoint detection and comparator circuits 30–33. System 26 of FIG. 1B comprises weighting function circuits 38, 39 and analog interpolation units 40–43. Units 40–43 each include dual multiplying digital to analog converter (DAM) units.

The outputs of units 40, 41 are respectively F(X) and F(Y) which are applied to a summer 46. Similarly, the outputs of units 42, 43 are F(Z) and F(W) which are applied to a summer 48. The outputs of summers 46, 48 are applied to summer 50 which provides F(X, Y, Z).

In FIG. 2, circuits 30–33 have respective distributed memories 51*a–b* through 54*a–b* all of which are generally shown as distributed memory 24 in FIG. 1B. Memories 51*a*–54*a* are breakpoint or "argument" memories which are loaded with the breakpoint values for $X_i - W_b$ respectively. Memories 51*b*–54*b* are difference memories which are loaded with the first differences $\Delta X_i - \Delta W_l$ respectively. Further, units 40–43 have respective distributed memories 61*a–b* through 64*a–b* which correspond to distributed memory 28 in FIG. 1B. Memories 61*a*–64*b* are the odd/even memories which are loaded during set up with the odd and even digital portions of the hybrid variables.

For example, for a given variable with X applied to circuit 30, this circuit generates $-\Delta X$ and $-(1-\Delta X)$ which are applied to circuit 38. The remaining circuits 31–33 respectively generate similar signals as shown in FIG. 2. All of the signals applied to circuits 38, 39, which is under the control of control unit 36, are effective to generate the function of more than one variable in accordance with predetermined weighting functions. These weighting functions are described in the above cited articles by Rubin and Chapelle. The outputs of weighting function circuit 38 are applied to units 40, 41 and the outputs of circuit 39 are applied to units 42, 43.

During function generation, the process of updating the state of system 20 whenever any of the variables crosses a breakpoint is extremely fast because the original function is systematically segmented and saved in a respective high speed distributed memory. Memories 51*a–b* to 54*a–b* as well as memories 61*a–b* to 64*a–b* are accessed in parallel. Thus, each of these memories operates at its maximum speed in parallel and independent of the other memories. As a result, comparators 30–33 operate in parallel as do units 40–43. In this way, the function generation is effectively taking place in parallel as compared with the serial accessing by computer 11 of system 10 in FIG. 1A. The event of a variable crossing a breakpoint triggers an update cycle in control unit 36 during which it modifies the addresses of the distributed memories in units 40–43.

DETAILED DESCRIPTION OF BREAKPOINT DETECTION AND COMPARATOR

Figure 3A:
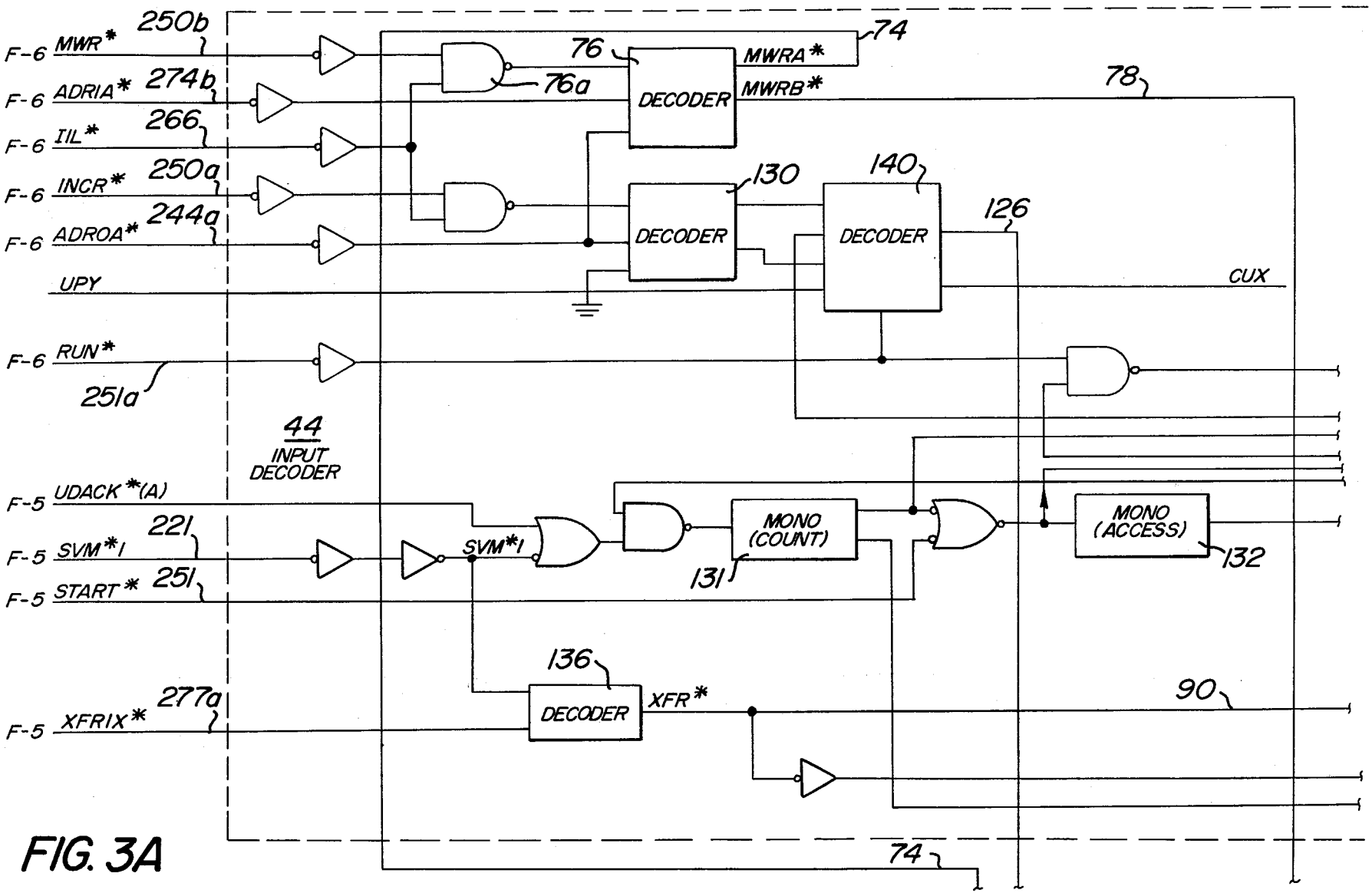
FIGS. 3A–C taken together illustrate in more detail and in block diagram form the breakpoint detection and comparator system of generator 20.
Figure 3B:
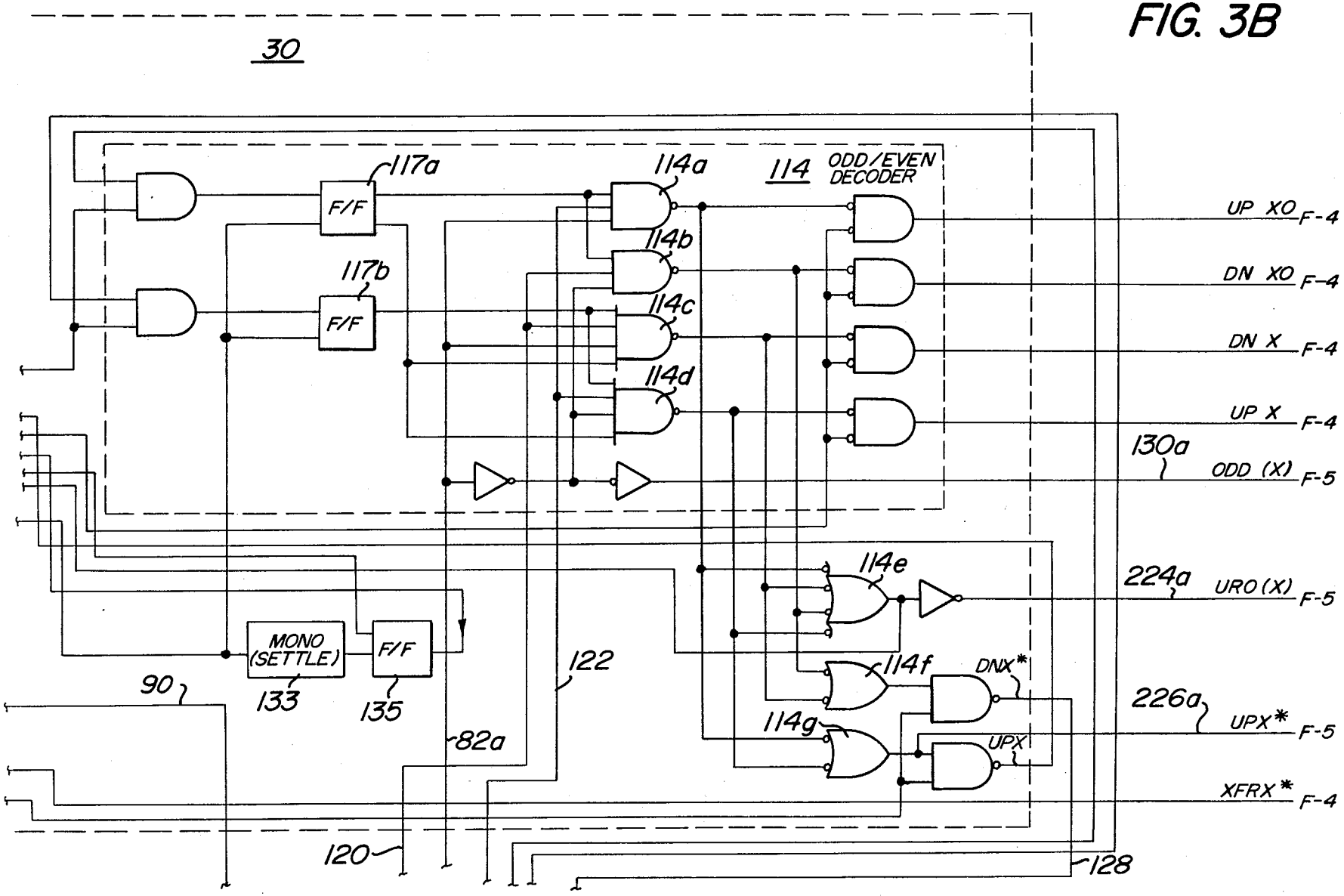
Figure 3C:
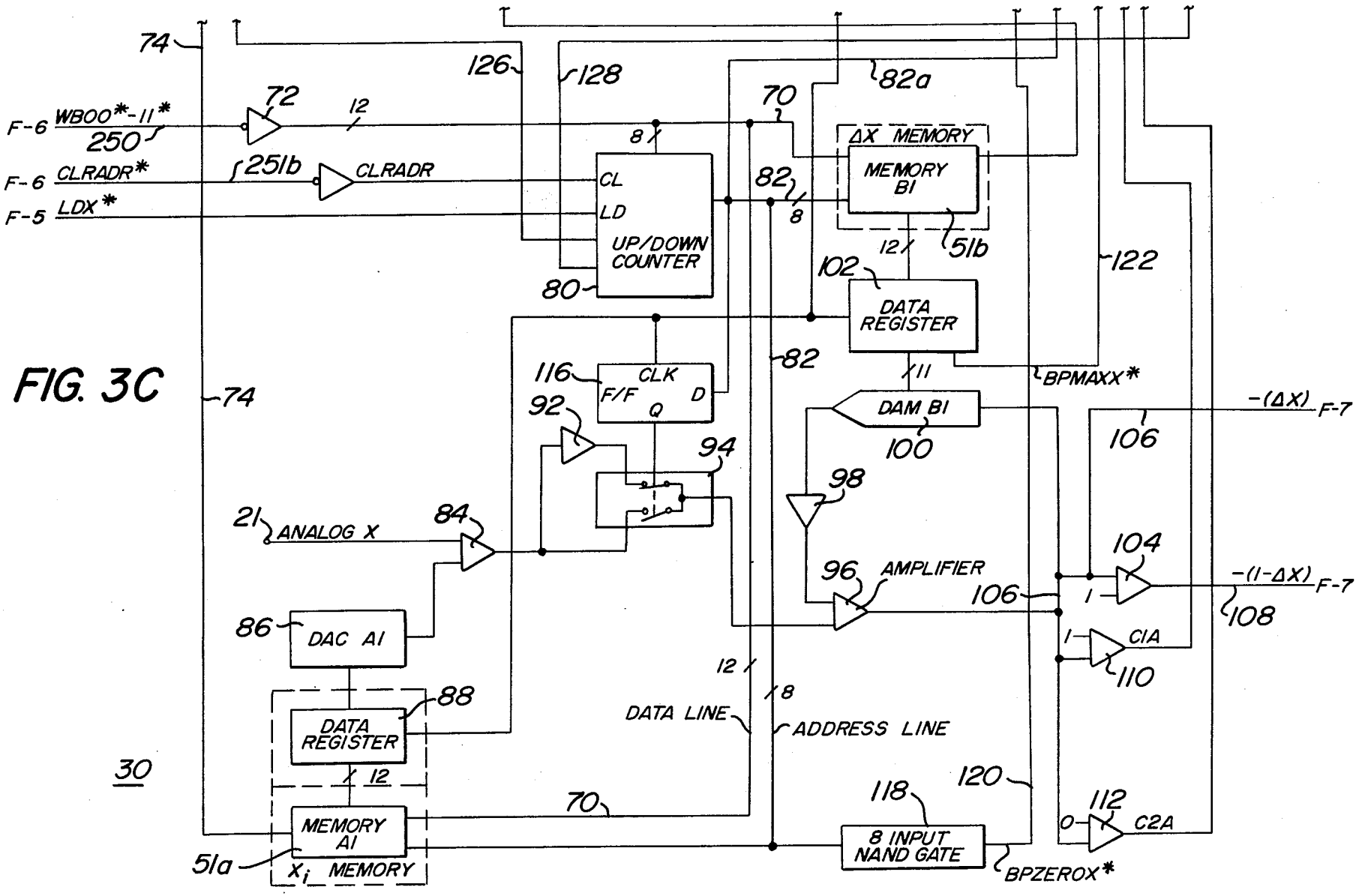

Referring now to FIGS. 3A–C, there is shown breakpoint detection and comparator circuit 30 of FIG. 2 in more detail. Since circuits 30–33 are identical only circuit 30 is described in detail. The differences in addressing each of circuits 30–33 is in accordance with the set up defined in the computer listing to be given later.

Distributed input memory (AI) 51*a* (argument memory) of cirucit 30 comprises a group of random access memories (RAMs) which are effectively loaded by computer 11 by way of a data line 70. Specifically, line 70 is coupled to the output of a set of buffers 72 which are fed by control unit 36 in FIGS. 6A-B (F-6) under the control of computer 11. A command line 74 is also coupled to memory 51*a* from a decoder 76 also controlled by computer 11 in FIGS. 6A-B.

The following operation will be described with respect to a function of a single variable. It will be understood that for the function of two or more variables, the operation is similar except for the order in which memories 51*a–b* of circuit 30 and memories 52*a–b*, 53*a–b* and 54*a–b* are loaded during set up time and accessed during the time of the generation of the function and depending upon the mode as set forth in the computer listing.

Input argument memory 51*a* is loaded during set up time with the breakpoints of single input variable X where those breakpoint values have been previously calculated by the user. Alternatively, the user may utilize computer 11 with conventional curve fitting or other breakpoint determination routines. For example, the breakpoints for at least one variable as well as the function values may be generated from a Digital Function Generation Package available with the EAI 8400 digital computer. This package is described in EAI Program Notes of 1966–67 as follows:

1. Introduction to Function Generation Subroutines — 827.6316
2. Argument Normalizing Subroutines — 827.6308
3. Function Generation Subroutines (FGS) — 827.6309
4. Function Table Processor (FTP) — 827.7016
5. Instructions for use of FTP — 827.7004
6. Function Table Display Program — 827.7049

Further, the IBM Continuous System Modeling Program (CSMP) provides a program for modeling a dynamic simulation system. As described in Hart, E. C.: "Improved Function Generation Subprograms for Use with CSMP or other Digital Simulation Programs," Digital Sumulation Techniques, Simulation Council, Inc., August 1971, CSMP has a table data input option which is used in the regular way with storage and table data. This program may be run to provide breakpoints and function values for two variables.

Figure 6A:
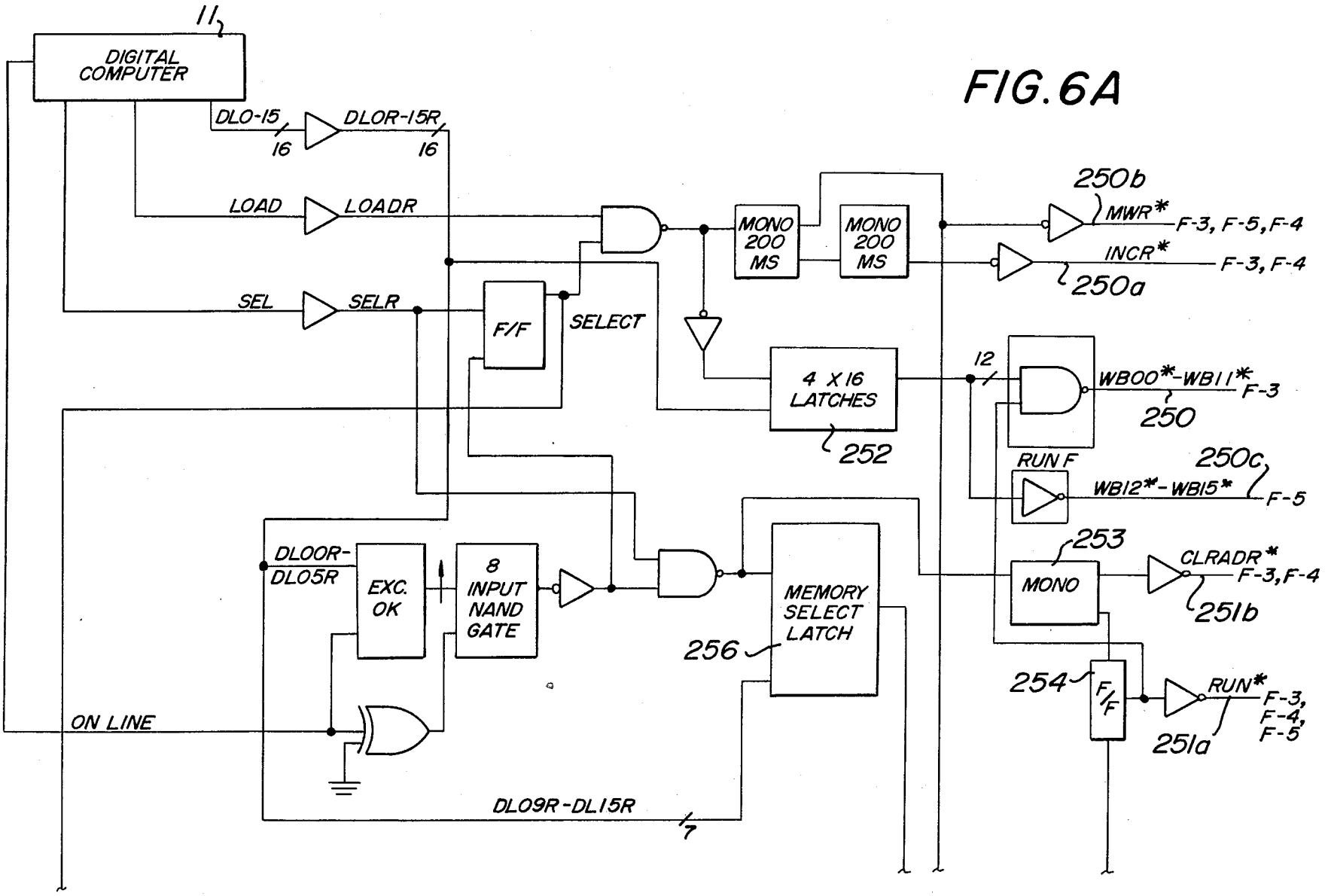
FIGS. 6A–B taken together illustrate in more detail and in block diagram form the remaining portion of the control unit of system 20.
Figure 6B:
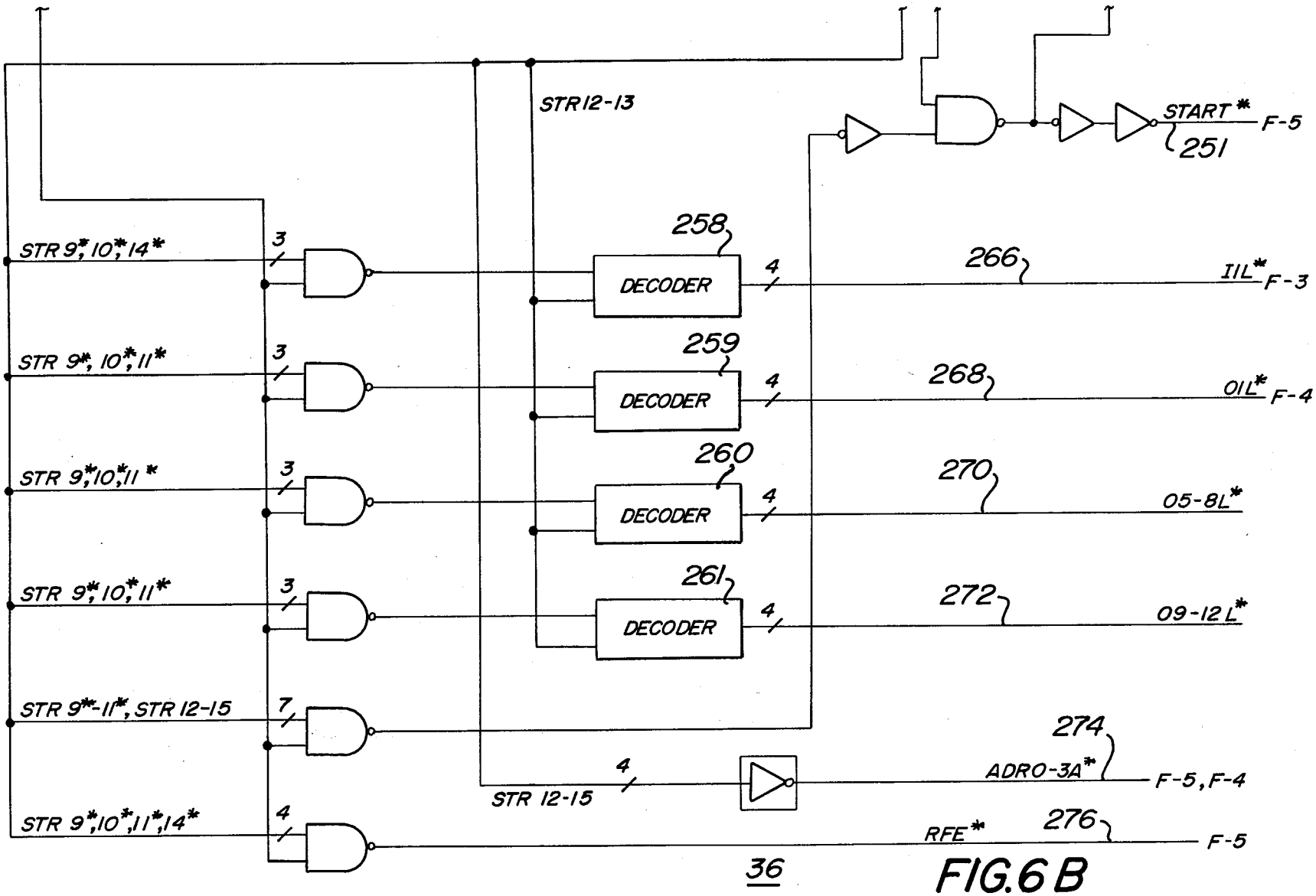

The loading of memory 51*a* is controlled by way of a memory write A* lines 74 which is coupled to decoder 76 and then to the computer interface shown in FIGS. 6A-B.

Similarly, memory BI 51*b* is loaded by way of data line 70 during set up time the values of the first differences 17, 17*a*, etc. as shown in FIG. 1C where those first difference values have previously been provided by the user or calculated in computer 11. The loading of memory 51*b* is controlled by way of a memory write B* line 78 which is coupled to decoder 76.

An up/down counter 80 is effective to address memories 51*a,b* by way of address line 82. When data from computer 11 appears on line 70 during set up, memories 51*a,b* are selected by control signals on memory write lines 74, 78. In addition, at that time the up/down counter 80 is loaded with the starting address. Every time one cell of memories 51*a,b* is loaded, then counter 80 is effective to count up 1 and to thereby address the next cell. In this way, the cells of memories 51*a–b* are consecutively loaded.

There has now been described the manner in which memories 51*a,b* have been set up. It will now be described, how crossing of the breakpoint by the input variable X is detected and how that information regarding the breakpoint detection is used in the generation of the desired output function. As previously described, the known analog input variable X is applied to input 21. Input 21 is connected as one input of summing amplifier 84, the other input of which is coupled to a digital to analog converter (DAC AI) 86 which is fed by a data register 88 coupled to memory 51*a*. In addition, data register 88 is controlled by transfer X* line 90.

The output of summing amplifier 84 is coupled either directly or through an analog inverter 92 to one of the terminals of a single pole, single throw semiconductor analog switch 94. The common terminal of switch 94 is coupled to one input of summing amplifier 96, the other input of which is connected to the output of inverter 98. Inverter 98 is fed through a multiplying digital to analog converter (DAM BI) 100. The analog input to DAM 100 is coupled to the output of amplifier 96 while the digital input to DAM 100 is coupled through a data register 102 to memory 51*b*. As in register 88, register 102 is controlled by line 90. The output of amplifier 96 is coupled to one input of another summing amplifier 104. The other input to amplifier 104 is a reference potential equal to a scaled analog voltage 1. Accordingly, the output of amplifier 96 represents $-\Delta X$ on line 106 while the output of amplifier 104 represents $-(1-\Delta X)$ on line 108. As previously described, these analog portions of hybrid variables, viz, $-\Delta X$ and $-(1-\Delta X)$ are fed to weighting function circuit 38 in FIGS. 7A-B.

The output of amplifier 96 corresponding to $-\Delta X$ is applied as one input to comparators 110 and 112. The other inputs of comparators 110, 112 are respectively 1 and 0 machine units respectively with the outputs of these amplifiers being applied to odd/even decoder 114 of input decoder section 44. Decoder 114 then determines which of the curves in FIG. 1D are to be selected.

Switch 94 is controlled by a D type flip-flop 116 which is clocked by line 90. In addition, one of the address lines 82*a* from counter 80 is applied to the data input of flip-flop 116 to provide the least significant bit. Address line 82 is nanded by an 8 input NAND gate 118 which generates a breakpoint zero X signal which is applied by way of line 120 to odd/even decoder 114. In addition, the twelfth bit of data register 102 is recognized as breakpoint maximum X signal and is coupled by way of line 122 also to decoder 114.

In function generation operation, with memory 51*a,b* having stored the breakpoints and the first differences, the input variable X is applied to input 21. When that input variable crosses the first breakpoint $X_1$ shown in FIG. 1C, then comparator 110 produces an up output. An up output is produced because variable X increases from $X_0$ to $X_1$ as it crosses $X_1$, a signal is generated by comparator 110. This signal is decoded by decoder 44 to produce a CUX* signal on line 126 and applied to up/down counter 80 which updates memories 51*a,b* to the next cell location. On the other hand, when the output of amplifier 96 goes below 0, then comparator 112 produces an output on line C2*a* which is applied to decoder 44. This produces a down X* signal on line 128 which is similarly applied to up/down counter 80.

In order to generate triangular waveshape $\Delta X$ shown in FIG. 1C at output 106, flip-flop 116 is switched by the least significant bit of counter 80 and is effective to actuate switch 94 for alternate intervals. The output of amplifier 84 is inverted and applied to amplifier 96.

In other words, as shown in FIG. 1D, for the first interval from $X_0-X_1$, waveform $\Delta X$ goes up from 0 to 1 which is detected at the 1 level by comparator 110. For the next interval from $X_1-X_2$, the waveform goes down and the crossover with the 0 axis is detected by comparator 112. The triangular waveshape $1-\Delta X$ is the complementary to $\Delta X$ and is generated by amplifier 104.

Figure 4A:
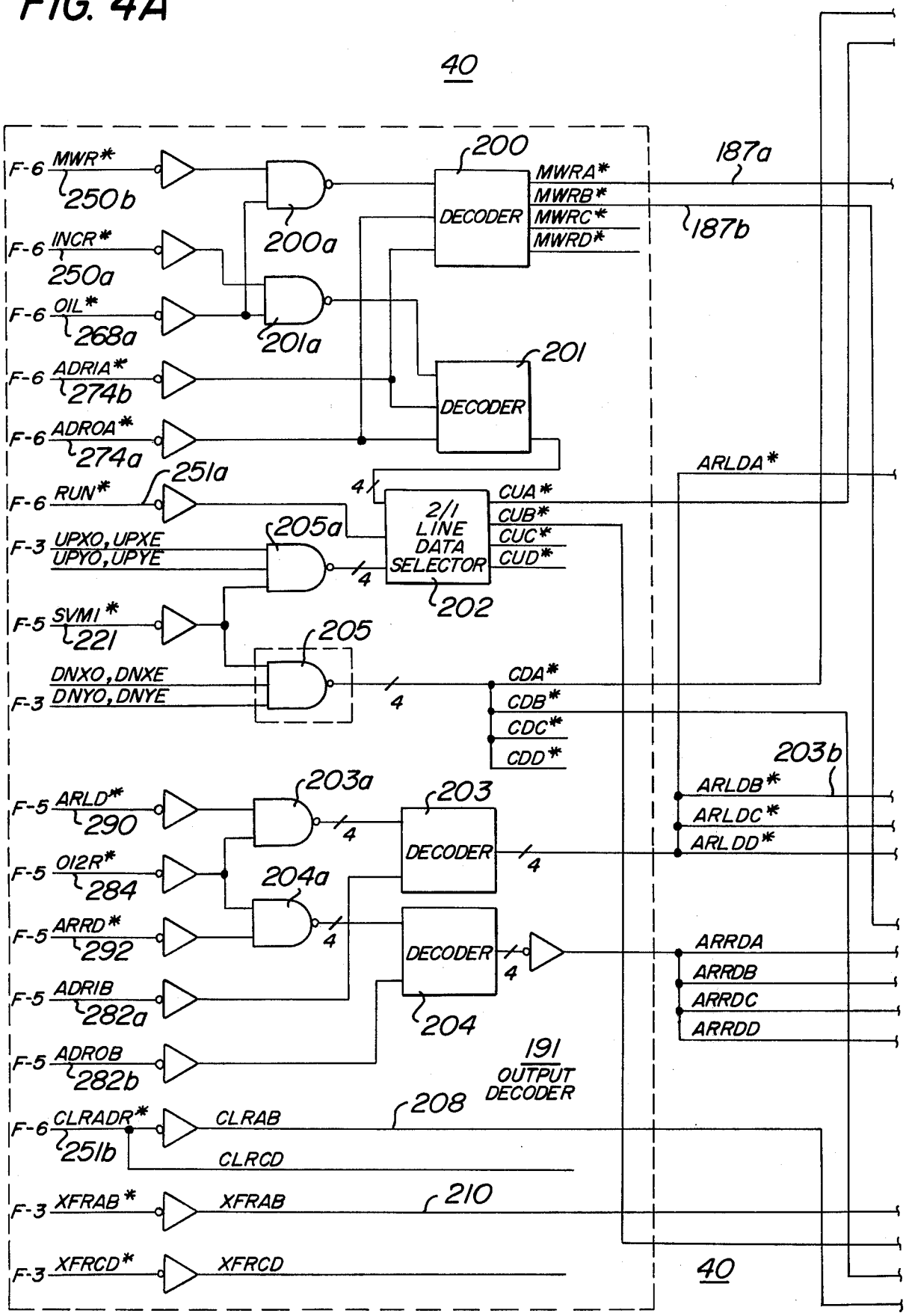
FIGS. 4A–B taken together illustrate in more detail and in block diagram form the analog interpolation unit of system 20.
Figure 4B:
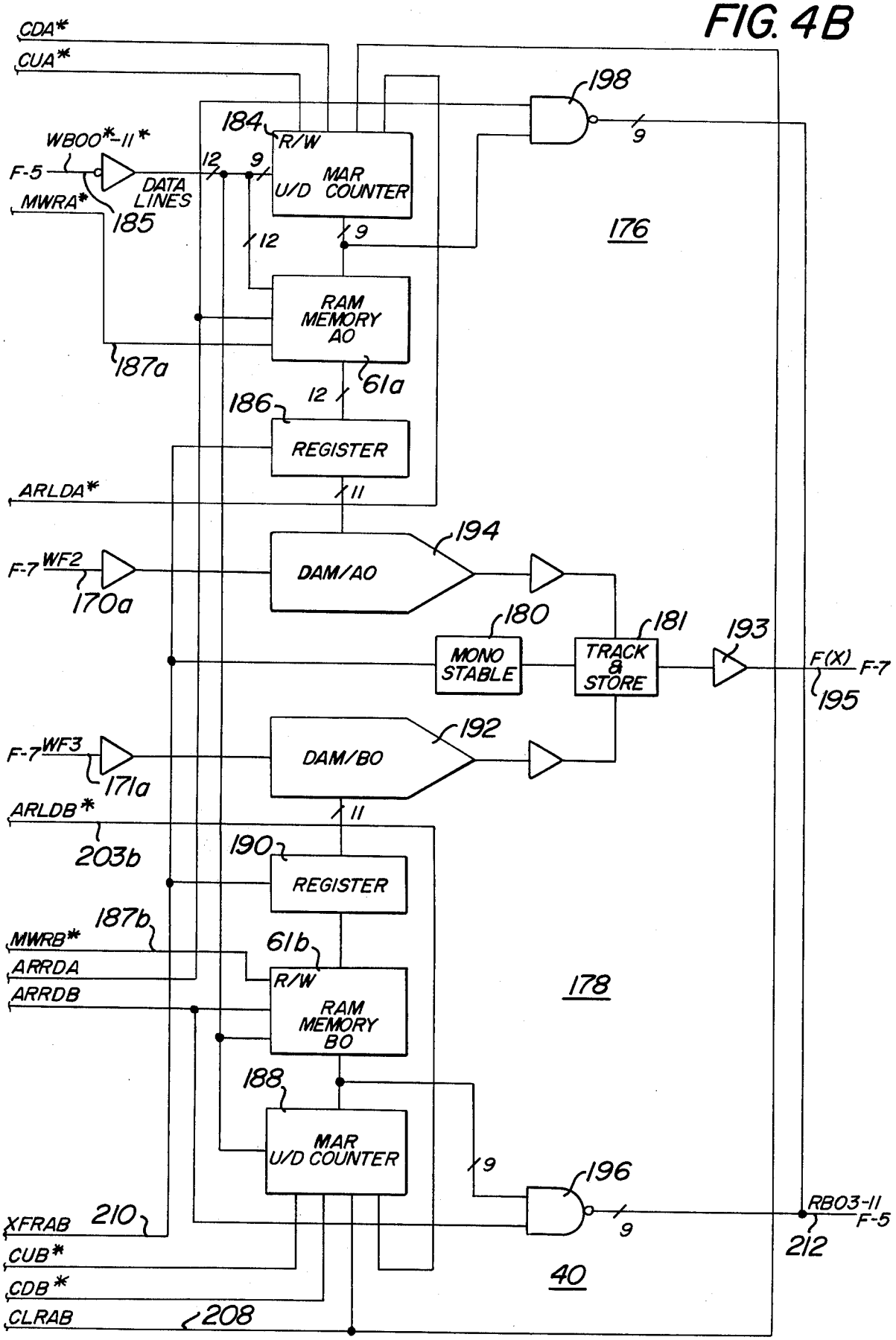
Figure 5A:
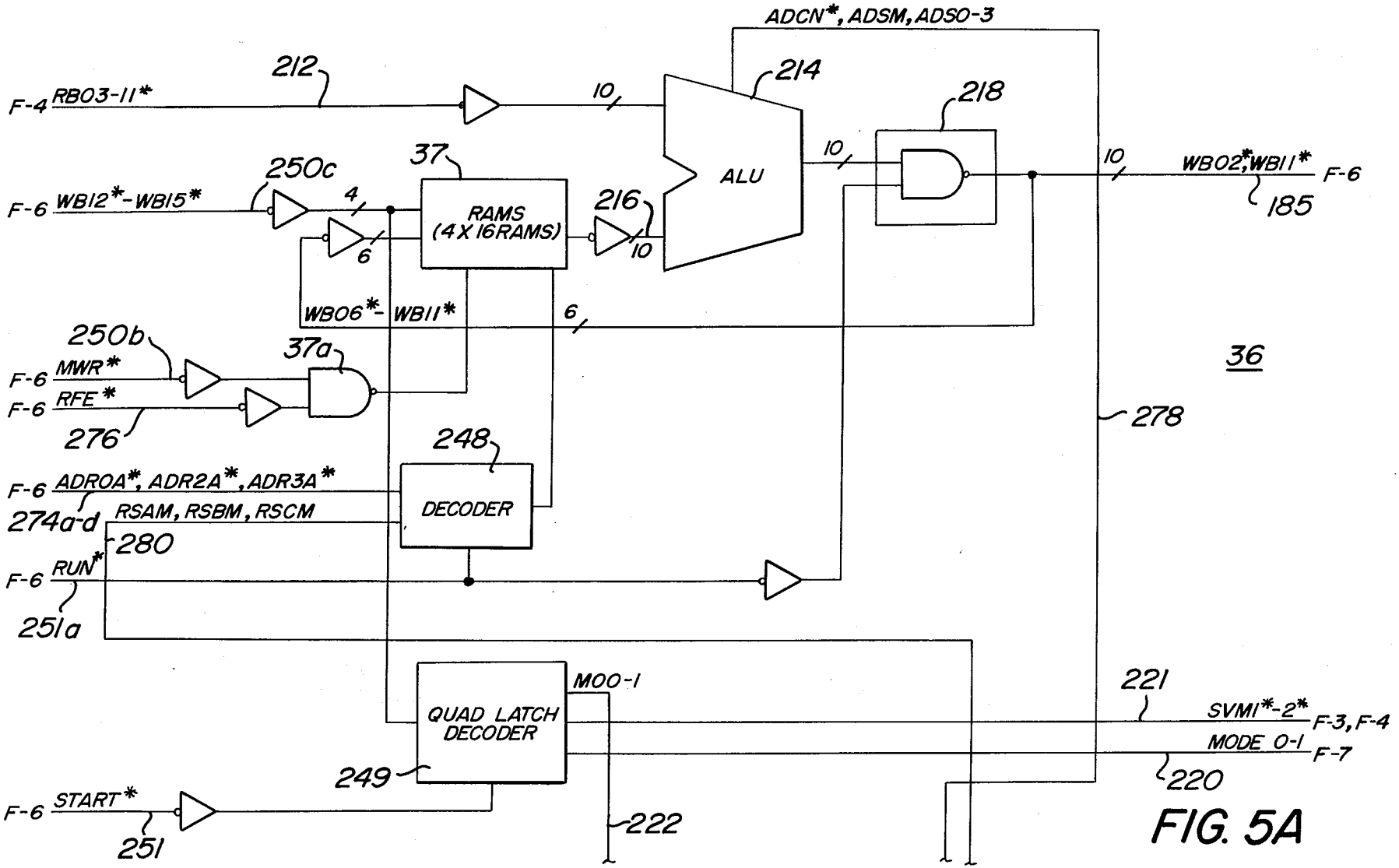
FIGS. 5A–B taken together illustrate in more detail and in block diagram form a portion of the control unit of system 20.
Figure 5B:
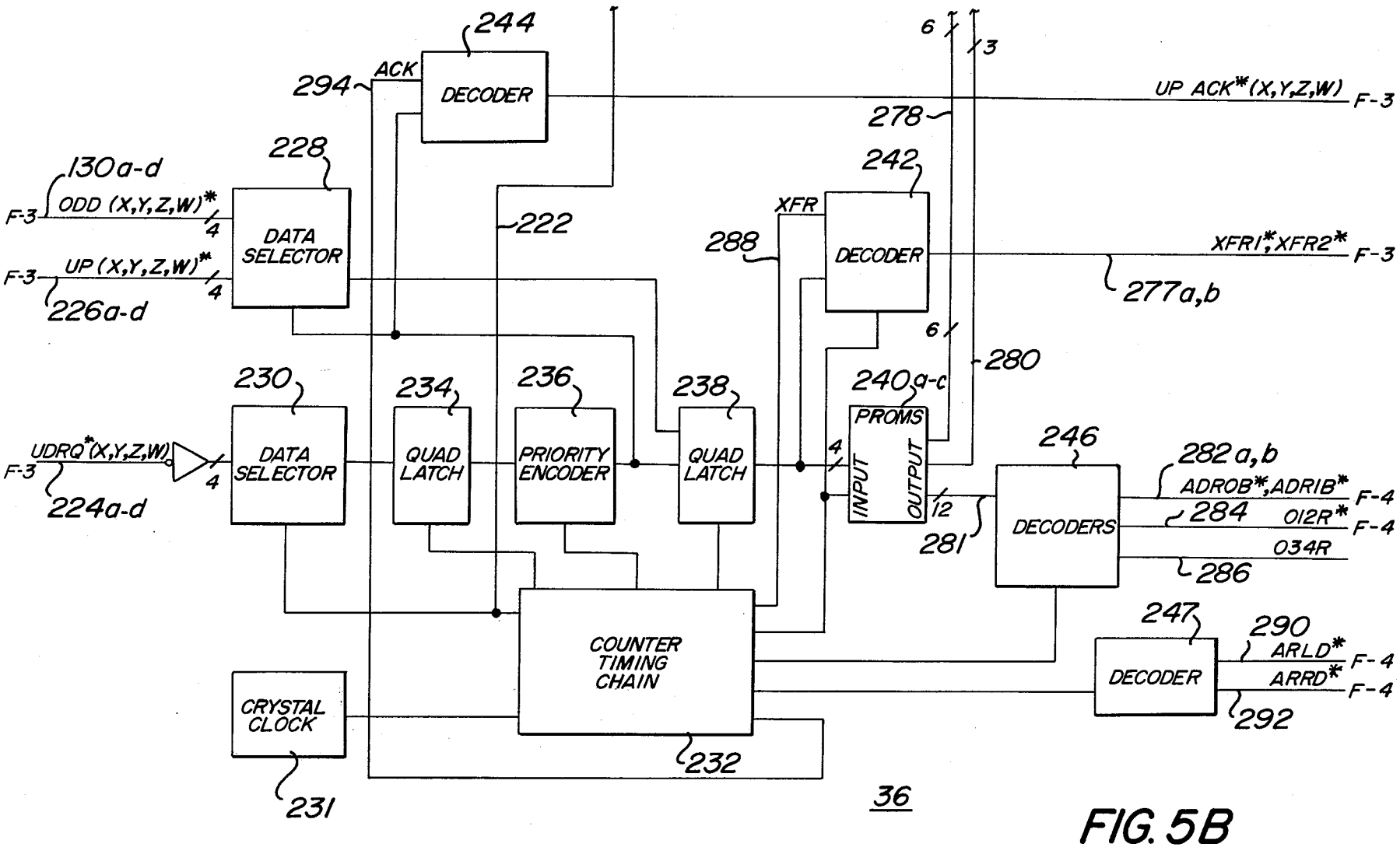

In input decoder 44, the start signal is supplied by control unit 36 in FIGS. 5A-B. The outputs of decoder 114 provide the up/down outputs for the odd and even intervals which are applied to unit 40 shown in detail in FIGS. 4A-B. Further output UDRQ (X) and odd output 130 are applied to control unit 36. In decoder 44, monostable multivibrators 131–133 and flip-flop 135 are all used for timing considerations with units 136, 138, and 140 being decoders.

WEIGHTING FUNCTION CIRCUIT

Figure 7A:
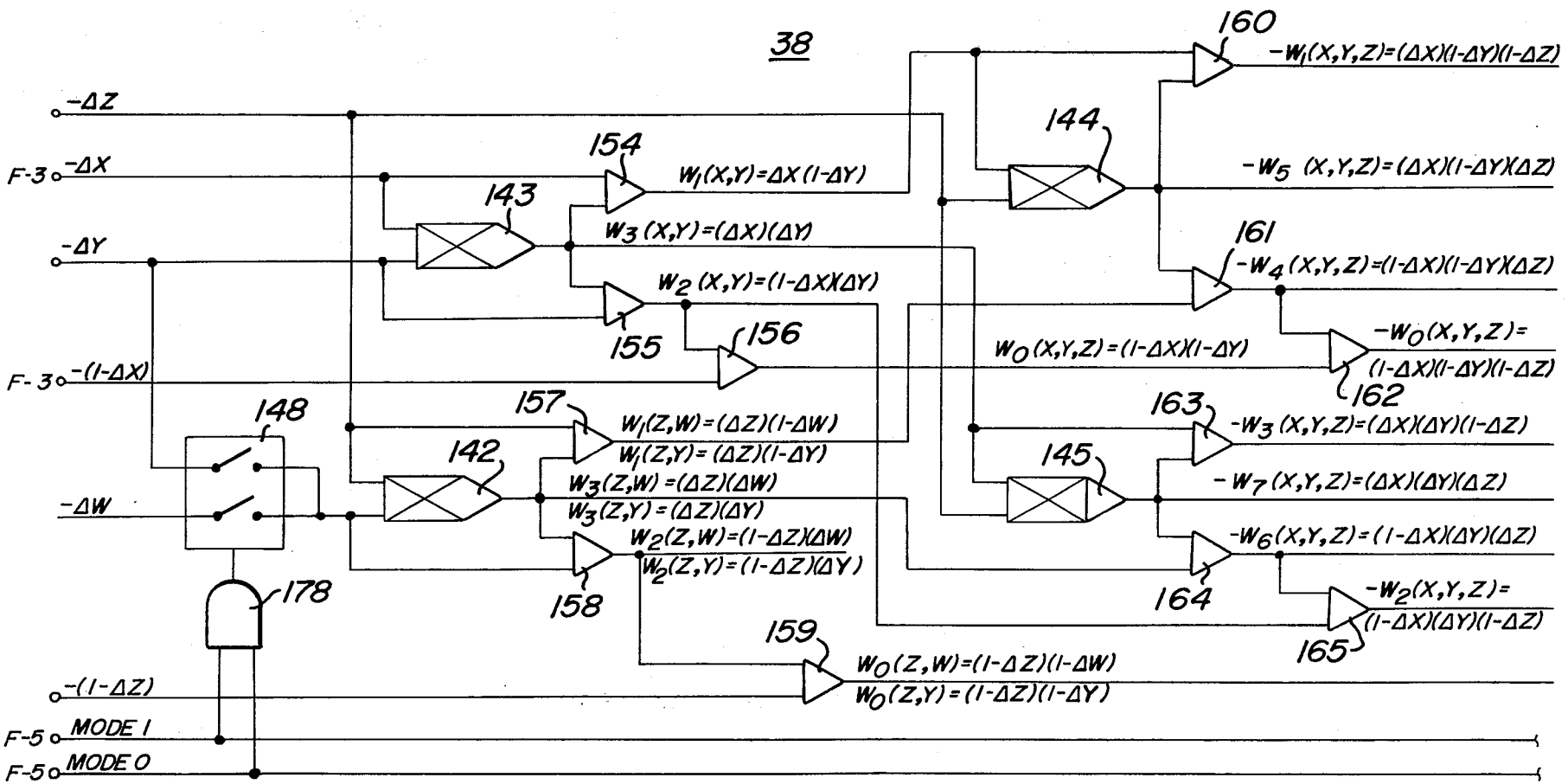
FIGS. 7A–B taken together illustrate in more detail and in block diagram form the weighting function circuit of system 20.
Figure 7B:
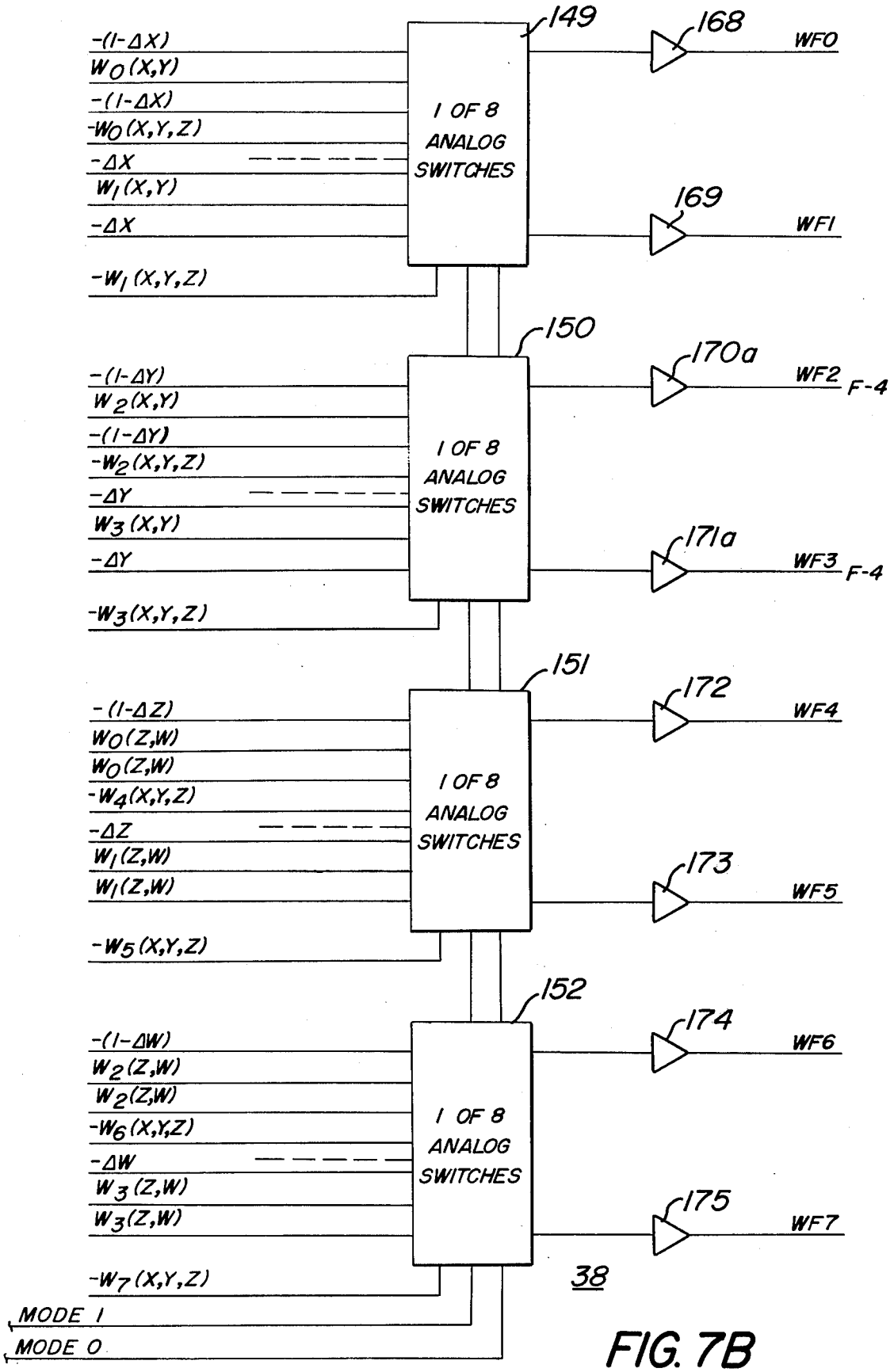

As shown in FIGS. 7A-B, weighting function circuit 38 comprises multipliers 142–145, analog voltage switches 148–152, summing ampllifiers 154–165, inverters 168–175 and an AND gate 178. Since circuit 39 has identical circuitry only circuit 38 will be described in detail. It will be seen that the input supply to circuit 38 are $-\Delta X$, $-\Delta Y$, $-\Delta Z$, $-\Delta W$, $-(1-\Delta X)$ and $-(1-\Delta Z)$. In addition, the inputs MODE 0 and MODE 1 are effective to select four different modes of operation in the generation of multivariant functions. Namely, depending upon the state of the inputs, one function of three variables F(X,Y,Z); two functions of two variables F(X,Y) and G(Z,W); one function of two variables and two functions of one variable – F(X,Y), G(Z), Q(W); and four functions of one variable F(X), G(Y), P(Z), Q(W).

The manipulation of the input signals are as indicated in FIGS. 7A-B and each of the outputs are marked in accordance with the specific mode selected. The analog outputs of these analog signals are applied to respective inputs as shown of analog switches 149–152 and the desired functions are selected depending upon the selected mode. The outputs of circuits 38 are applied to respective inputs of FIGS. 4A-B – 6A-B. Specifically, outputs 170*a*, 171*a* respectively, are inverted and are applied to inputs of DAMS 194, 192 as shown in FIGS. 4A-B.

ANALOG INTERPOLATION UNIT

As shown in FIGS. 4A-B, unit 40 has applied thereto the weighted function values on input lines 170*a*, 171*a* and is effective to multiply these weighted analog values by digital numbers previously loaded in memories 61*a,b*. Since units 41–43 are identical to unit 40 with the respective addressing differences being in accordance with the computer listing, only unit 40 will be described in detail. The upper section 176 of unit 40 is effective to provide odd multiplication as shown in FIG. 1D for the case of a function of a single variable. Lower section 178 is effective to provide even multiplication as shown in FIG. 1E. The outputs of sections 176 and 178 are summed together by summer 193 after inversion to provide function F(X) on line 195.

Sections 176, 178 respectively include a RAM memory (AO) 61*a* and a RAM memory (BO) 61*b* each of which comprises a group of RAMs. As previously described with respect to memories 51*a–b*, function values or tables of values may be generated by computer 11 using known programs or these values may be calculated by the user. During set up time, these values ae loaded into dedicated memories 61*a,b*. Specifically, data frcm computer 11 and unit 36 are applied by way of lines 185 to memories 61*a,b*. The memories are selected by memory write lines 187*a,b* which are effective to write the data in the memory 61*a,b* at a desired address as determined by the up/down counters 184 and 188. In this way, memories 61*a,b* are addressed by respective up/down counters 184, 188.

It will now be understood that during set up time for the function of a single variable, computer 11 calculates the desired $F(X_i)$ for both the odd interval and the even interval in order to calculate the desired function. Thus, during set up, counters 184, 188 are loaded with the address values applied from data line 185. This hybrid information is consecutively loaded into memories 61*a,b* by means of incrementing counters 184, 188 for successive loading of the memory. Thus, while in FIGS. 3A-C, a single up/down counter 80 is effective to simultaneously control the sequential loading and operation of memories 51*a,b* in FIGS. 4A-B two separate up/down counters 184, 188 are required for this control because of the odd/even requirements.

The outputs of memories 61*a,b* are latched into registers 186, 190 the outputs of which are applied to dual DAM units 194 and 192 respectively. The analog values of the hybrid variables in the form of weighting functions from the weighting function circuit of FIGS. 7A-B are applied by way of input lines 170*a*, 171*a* to the inputs of DAM units 194, 192, respectively.

In unit 40 as shown in FIGS. 4A-B, the loading, addressing and clearing of the memories, counters and registers are controlled by output decoder 191 in which the various applied signals are decoded by decoders 200–205. Specifically, the memory write line 187*a* is effective to cause the selective writing of memory 61*a* while memory write line 187*b* is effective to cause the selective writing of memory 61*b*. Further, address loading line 203*a* selects the loading of the address counter 184 while line 203*b* selects the loading of address counter 188. The up counting of counters 184, 188 is countrolled by decoder 202 while the down counting of these counters is controlled by NAND gates 205. Counters 184, 188 are cleared by clear line 208 while the transfer of information from memories 61*a,b* to the registers 186, 190 respectively are controlled by transfer line 210.

Figure 1G:
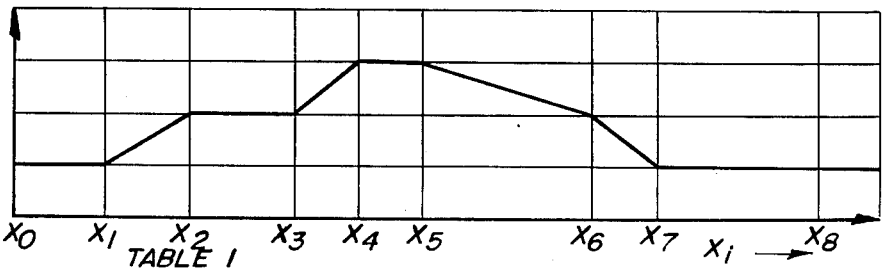

After set up of a function of a single variable, during the generation of the function, the analog portions of the hybrid variables are applied on lines 170*a*, 171*a*. It will be understood for this single variable, the signals are shown in FIG. 1C. At the same time as the input analog variable X is crossing breakpoints, odd/even decoder 114 applies signals to output decoder 191. These odd/even signals are effective to increment or decrement counters 184, 188 which addresses memories 61*a,b* in the desired locations in order to obtain $F(X_i)$ and $F(X_{i+1})$. Accordingly, in order to calculate F(X) in accordance with equation 1, $F(X_i)$ representing the even interval is multiplied by the analog variable for the even interval, viz $1-\Delta X$. This multiplication takes place in DAM 194. Similarly, $F(X_{i+1})$ is multiplied by the analog portion $\Delta X$ for the odd interval in DAM 192. These multiplications are shown in FIGS. 1E, 1F. The outputs of DAMs 194, 192 are inverted and added by summing amplifier 193 the output of which is the desired function F(X) on line 195 and is shown in FIG. 1G for the function of the single variable X.

It will be understood that track and store unit 181 is used for temporary storage of the analog signal to the input of amplifier 193 when the foregoing multiplication within DAMs 194, 192 takes place. This procedure enables for the avoidance of transient errors during switching of digital data into DAMs 194, 192. It should be noted that track and store unit 181 is controlled by XFRAB line applied to monostable multivibrator circuit 180 as shown in FIGS. 4A-B.

A. Function of Two or More Variables

As previously described with respect to equation 2, for the function of two variables, there is provided a multiplication of an analog portion by an associated digital portion of a hybrid variable in each of the four subequations. During set up time, memories 61*a–b* and 62*a–b* or units 40, 41 are loaded in accordance with the values set forth in Table II. Table II is an example of 16 × 16 breakpoints in which there are 64 addresses in each of the memories 61*a–b* and 62*a–b* as indicated. For example, at address "O", $F(X_0, Y_0)$ is loaded in memory 61*a*. An address "8", $F(X_{14}, Y_0)$ is also loaded in memory 61*a* and so on. It is to be noted that memory 61*a* is loaded with the digital portion of the even values of X and the even values of Y indicated as "*ee*". Similarly, memory 61*b* is loaded with the odd values of X and the even values of Y indicated as "*oe*", memory 62*a* is loaded with the even values of X and the odd values of Y, etc.

During actual generation of a two variable function, viz, F(X,Y), the starting addresses for the up/down counters 184, 188 are effective to address memories 61*a,b* at address 0 as shown in Table II. Memories 62*a–b* are similarly addressed. When variable Y crosses an even breakpoint, the address of memory 61*a* is changed from the previous address 0 to address 8 by means of control unit 36.

This jumping from address 0 to 8 provides the digital portion of the next Y breakpoint. A jump by 8 is equivalent to the modification of the addresses of counters 184, 188 where the value of 8 corresponds to half the number of breakpoints in X (which in this case is 16) or the actual number of even breakpoints (which in this case is 8). It will be understood that if an initial address were other than 0 such as 2, for example, then the jump would be from address 2 to address 10. On the other hand, for memory 61*a* when the variable X crosses an even interval, the memory address increments by one from address 0 to 1, for example, etc.

With respect to memory 61*b*, when the X variable crosses an odd breakpoint, then the memory address is incremented by one. However, when the Y variable crosses an even breakpoint, then a jump of 8 in address is provided in the manner previously described for memory 61*a*. Accordingly, there is a jump in 8 for both memories 61*a,b* when the variable Y crosses an even breakpoint. Similarly, the addresses for memories 62*a,b* jump by 8 when the Y variable crosses an odd breakpoint. Memory 62*a* increments by one when the variable X crosses an even breakpoint and memory 62*b* increments by one when the variable X crosses an odd breakpoint. It is in this manner that the digital portions of the hybrid variables set forth in equation 4 are accessed.

In the foregoing description, both variables X and Y have been explained as crossing a breakpoint going up. It will be understood that these variables may also cross breakpoints going down. In that case, the addresses to counters 184, 188 are programmed to decrement memories 61*a,b* by a decrement of one or by a jump down of 8.

With respect to a function of three variables, equation 3 shows that 8 digital portions of the hybrid variables are required as well as 8 analog portions. As previously described, the analog portions are generated by weighting function circuits 38, 39 and the digital portions are provided by memories 61*a–b*, 62*a–b*, 63*a–b* and 64*a–b* of units 40–43 respectively. Table III sets forth the mapping of the foregoing memories and the operation of these memories. The addressing and the updating of the addressing operate similar to that set forth with respect to Table III. For example, when the variable Z crosses a breakpoint, then the respective memory address jumps by a number equal to the product of the number of even breakpoints in X and the number of odd breakpoints in Y. In this manner, there is accessed the correct table of values in the memory mapped in Table III.

CONTROL UNIT 36

A portion of control unit 36 is shown in FIGS. 5A-B with the remaining portion shown in FIGS. 6A-B. The portion of unit 36 shown in FIGS. 5A-B provides control for RAM memories 37 and for ALU 214 in order to generate the modified addresses in a given mode of operation such as one, two or three variable function generation.

The present values of addresses of counters 184, 188 in FIGS. 4A-B are passed through NAND gates 198, 196 respectively to lines 212. Within control unit 36, these present values are modified by the values contained in extent memory 37. Specifically, the values are applied by way of lines 212 to arithmetic logic unit ALU 214 with the ALU also being fed by memories 37 by way of line 216. Memories 37 comprise 4 × 16 RAMs. The output of ALU 214 is applied to a NAND gate 218 and then to line 185 thereby to modify the values in counters 184, 188 in FIGS. 4A-B. Mode signals are generated by decoder 249 on lines 220 and 222. Decoder 249 also generates a SVM 1*-2* signal on line 221 which is applied to the input decoder 44 in FIGS. 3A-C and NAND gates 205 and 205*a* shown in FIGS. 4A-B.

In addition, the portion of control unit 36 in FIGS. 5A-B is also effective to receive signals relating to the odd/even and the up and down counts ODD(X) and UP(X) of FIGS. 3A-C. Further, the UD request signals from FIGS. 3A-C are also received by unit 36 by way of line 222*a*. Specifically, lines 130*a* and 226*a* are connected to data selector 228 and lines 224 are connected to data selector circuit 230. It will be understood that lines 130*b–d* and 226*b–d* are correspondingly connected to circuits 31–33 respectively in similar manner to that described with respect to circuit 30. In FIG. 5B, crystal clock 231 supplies a counter and timing chain 232 which generates the proper timing for the components of unit 36. Data selector 230 receives up or down request lines 224*a–d* and is effective to select the proper request under the control of mode signals on lines 222. The output of selector 230 is latched by quad latch 234, the output of which is applied to priority encoder 236 which sets up a priority of a given mode of operation. The output of data selector 228 and encoder 236 are fed to a latch 238 which in turn provides an input to PROMS 240.

The output of PROMS 240 are provided on lines 278, 280 and 281. Lines 278 and 280 are applied to ALU 214 and decoder 248 respectively as shown in FIGS. 5A-B. Output lines 281 of PROM 240 are applied to decoders 246. PROMS 240*a–c* are programmed to generate signals which control the operation of the addressing of memories 37 and the operation of ALU 214.

A table of input addresses and output signals that may be used for PROMS 240*a–c* are set forth as follows:

TABLE IV

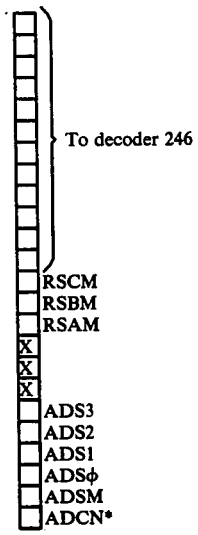

| INPUT | | | | OUTPUT 240c | 240b | 240a |
|---|---|---|---|---|---|---|
| MODE 4 | ODD | UP | VAR | Hϕ5 8 7 6 5 4 3 2 1 | Fϕ5 8 7 6 5 4 3 2 1 | Dϕ5 8 7 6 5 4 3 2 1 |
| 0 | 0 | 0 | 00 | 001011 | xxx | 111101 |
| 0 | 0 | 0 | 01 | 010011 | 001 | 011000 |
| 0 | 0 | 0 | 10 | 101111 | xxx | 111101 |
| 0 | 0 | 0 | 11 | 110111 | 101 | 011000 |
| 0 | 0 | 1 | 00 | 000010 | xxx | 000000 |
| 0 | 0 | 1 | 01 | 000001 | 001 | 100101 |
| 0 | 0 | 1 | 10 | 100110 | xxx | 000000 |
| 0 | 0 | 1 | 11 | 100101 | 101 | 100101 |
| 0 | 1 | 0 | 00 | 000010 | xxx | 111101 |
| 0 | 1 | 0 | 01 | 000001 | 001 | 011000 |
| 0 | 1 | 0 | 10 | 100110 | xxx | 111101 |
| 0 | 1 | 0 | 11 | 100101 | 101 | 011000 |
| 0 | 1 | 1 | 00 | 001011 | xxx | 000000 |
| 0 | 1 | 1 | 01 | 010011 | 001 | 100101 |
| 0 | 1 | 1 | 10 | 101111 | xxx | 000000 |
| 0 | 1 | 1 | 11 | 110111 | 101 | 100101 |
| 1 | 0 | 0 | 00 | 00101110 | 1111xxx | 111101 |
| 1 | 0 | 0 | 01 | 01001111 | 0111001 | 011000 |
| 1 | 0 | 0 | 10 | 10010111 | 0111011 | 011000 |
| 1 | 0 | 0 | 11 | | | |
| 1 | 0 | 1 | 00 | 00001010 | 0110xxx | 000000 |
| 1 | 0 | 1 | 01 | 00000110 | 0101001 | 100101 |
| 1 | 0 | 1 | 10 | 00000101 | 0011011 | 100101 |
| 1 | 0 | 1 | 11 | | | |
| 1 | 1 | 0 | 00 | 00001010 | 0110xxx | 111101 |
| 1 | 1 | 0 | 01 | 00000110 | 0101001 | 011000 |
| 1 | 1 | 0 | 10 | 00000101 | 0011011 | 011000 |
| 1 | 1 | 0 | 11 | | | |
| 1 | 1 | 1 | 00 | 00101110 | 1111xxx | 000000 |
| 1 | 1 | 1 | 01 | 01001111 | 0111001 | 100101 |
| 1 | 1 | 1 | 10 | 10010111 | 0111011 | 100101 |
| 1 | 1 | 1 | 11 | | | |

The input signals to PROMS *a–c* are applied by way of five lines which are effective to address thirty-two different memory locations in each of the PROMS 240*a–c*. Each of the PROM memories 240*a–c* has eight outputs. This enables for generation 24 output lines though in the example of Table IV, only 21 output lines are used as shown by lines 278, 280 and 281.

The outputs of decoder 246 are applied by way of lines 282*a,b* through inverters to decoders 203, 204 respectively in FIGS. 4A-B. Line 284 after inversion is applied to NAND gates 203*a*, 204*a* as shown in FIGS. 4A-B. Latch 238 feeds decoder 242 which provides a transfer line which is coupled to circuits 30 of FIGS. 3A-C by way of lines 277*a–b*. The output of encoder 236 is also applied to a decoder 244 which generates and up/down acknowledge signal for circuit 30 in FIGS. 3A-C.

Decoder 247 receives timing signals from chain 232 and is effective to generate address load and address read signals which are applied to unit 40, FIGS. 4A-B, by way of lnes 290, 292. These signals cause the loading of counters 184, 188 and also the reading of the output of these counters by way of 1 of 4 decoders 203, 204. Timing circuit 232 also generates an acknowledge signal 294 which is applied to decoder 244 as shown in FIGS. 5A-B. The quad latch decoder 249 is under the control of the start signal on line 251 from the portion of control unit 36 in FIGS. 6A-B. This is effective to generate more signals on line 222 to select the mode within weighting function circuit 38 by way of lines 220. During set up time, memory RAMs 37 are loaded by way of lines 250 from unit 36.

FIGS. 6A-B illustrate that portion of the control unit 36 which operates as an interface between computer 11 and function generator 20. Specifically, unit 36 provides buffering of the data lines from computer 11 and generates the clear address and the run and start signals used in the operation of circuits 30–33 and units 40–43. The memory write signal is generated on line **250*b* and is applied to NAND gate 37*a* (FIG. 5A) after inversion. Line 250*b* is also coupled to NAND gates 76*a* in input decoder 44 in FIG. 3A and NAND gates 200*a* (FIGS. 4A-B) after suitable inversion. Line 250*a* is applied to NAND gate 201*a* in FIGS. 4A-B and NAND gate 138*a*** after suitable inversion.

Monostable 253 and flip-flop 254 operate to provide the necessary timing delays for the clear and run signals on lines **251*b* and 251*a* respectively as shown in FIGS. 6A-B. Line 251*b* is coupled to up/down counter 80 after inversion in FIGS. 3A-C. Line 251*b* is also coupled to U/D counters 184 and 188 respectively as shown in FIGS. 4A-B. A run signal is applied by way of line 251*a* through an inverter (FIG. 3A) to decoder 140. The run signal is also applied to decoder 248 and NAND gates 218 (FIGS. 5A-B). A start signal on line 251 is applied to decoder 249** as shown in FIG. 5A.

The data from computer 11 is decoded by way of decoders 258–261 which are effective to generate signals which enable the loading of predetermined banks of memories **51*a–b* through 54*a–b* and 61*a–b* through 64*a–b*. The outputs of decoders 258–261 are coupled to these memories by way of lines 266–272**.

TABLE OF COMPONENTS

In the variable analog function generator 20, the following components have been used for the operation and function as described and shown.

| REFERENCE CHARACTER | COMPONENT | MODEL NO. | MANUFACTURER |
|---|---|---|---|
| 11 | Digital Computer | PACER 100 | Electronic Associates, Inc. |
| 37 | RAMs | 7489(3X) | Texas Instruments |
| 51a, 51b | RAM Memory | 2101(3X) | Advanced Micro-Devices |
| 61a, 61b | RAM Memory | 2101(6X) | Advanced Micro-Devices |
| 72 | Buffers | 74LS04(2X) | Texas Instruments |
| 76, 138, 258, 259, 260, 261 | Decoder | 74LS139 | Texas Instruments |
| 80 | Up/Down Counter | 74LS193(2X) | Texas Instruments |
| 117a,b | Flip-flop | 74LS74 | Texas Instruments |
| 184 | Up/Down Counter | 74LS193(3X) | Texas Instruments |
| 84, 92, 96, 98, 104, 193, 154–165, 168, 169, 172–175 | Amplifiers | AD518K | Analog Devices |
| 86 | DAC | DAC 80 | Burr-Brown |
| 94 | Switch | DG191 | Siliconix |
| 100, 194, 192 | DAM | AD7521LN | Analog Devices |
| 102, 88, 186, 190 | Data Register | 74LS175(3X) | Texas Instruments |
| 110, 112 | Comparators | 311 | National |
| 116 | Flip-flop | ½ 74LS74 | Texas Instruments |
| 131 | Monostable | ½ 74123 | Texas Instruments |
| 180 | Monostable | 74123 | Texas Instruments |
| 136, 140, 202, 242, 248, 244 | Decoder | 74LS157 | Texas Instruments |
| 142–145 | Multipliers | 4204K | Burr-Brown |
| 148 | Analog Switch | DG191 | Siliconix |
| 149–152 | Analog Voltage Switch | DG509LS | Siliconix |
| 188 | Up/Down Counter | 74LS193(3X) | Texas Instruments |
| 200, 201, 203, 204 | Decoders | ½ 74LS139 | Texas Instruments |
| 214 | ALU | 74LS181(3X) | Texas Instruments |
| 228, 230 | Data Selector | 74LS153 | Texas Instruments |
| 232 | Counter Timing Chain | 74LS175 | Texas Instruments |
| | | 74LS00 | Texas Instruments |
| | | 74LS04 | Texas Instruments |
| 234, 238 | Quad Latch Decoder | 74LS175 | Texas Instruments |
| 236 | Priority Encoder | 9318 | Fairchild |
| 240 | PROMS | IM5600(3X) | Intersil |
| 246 | Decoders | 74LS153 | Texas Instruments |
| 247 | Decoders | 74LS04 | Texas Instruments |
| 249 | Quad Latch Decoder | 74LS175 | Texas Instruments |
| | | 7404 | Texas Instruments |
| | | 74H00 | Texas Instruments |
| 252 | Memory Select Latch | 74LS175(4X) | Texas Instruments |
| 253 | Monostable | 74123 | Texas Instruments |
| 256 | Memory Select Latch | 74LS715(2X) | Texas Instruments |

COMPUTER PROGRAM FOR SET UP

There follows a computer program written in FORTRAN language for loading memories **51*a–b* through 54*a–b*, 61*a–b* through 64*a–b* and 37** during set up time. The explanation for the various terms used in writing the program are explained in the form of comment statements which are referenced by the letter "C".

```
C     /* MVFG RTL SUBROUTINE TO LOAD THE FUNCTION DATA OF A FUNCTION OF
C          TWO VARIABLES, FROM A FLOATING POINT, UNSCALED ARRAY */
C     /* THE ROUTINE 1) CHECKS FOR ERROR
C     /*             2) LOADS THE FOUR FUNCTION MEMORIES,
C     /*                IN THE FOLLOWING ORDER:
C     /*                   EVEN, EVEN
C     /*                   ODD, EVEN
C     /*                   EVEN, ODD
C     /*                   ODD, ODD */
```

```
C    /* NOTE:  THE MVFG HARDWARE INDEXING STARTS WITH ZERO, WHILE
C               FORTRAN MUST START WITH ONE.  HENCE, THE FORTRAN INDEX
C               IS ONE GREATER THAN THE HARDWARE INDEX.  REFERENCES TO
C               INDICES ARE TO HARDWARE ONES. */
C    /* DECLARE QWF2R ENTRY ((*,*,*,*,*,*,*) INTEGER,INTEGER,REAL,INTEGER,
C         INTEGER,REAL,INTEGER)
C    PROCEDURE QWF2R (LU,FNO,FARRAY,NBPTS1,NBPTS2,FSCALE,EFLAG)
C
                                        SUBROUTINE QWF2R(LU,FNO,FARRAY,NBPTS1,
     1                                          NBPTS2,FSCALE,EFLAG)
                                        INTEGER LU,FNO,NBPTS1,NBPTS2,EFLAG
                                        REAL FARRAY, FSCALE
C
C    /* ARGUMENT LIST VARIABLES:                                          */
C    /*          LU          LOGICAL UNIT                                 */
C    /*          FNO         FUNCTION NUMBER                              */
C    /*          FARRAY      ARRAY OF FUNCTION VALUES                     */
C    /*          NBPTS1      NUMBER OF ARGUMENT ONE BREAK POINTS          */
C    /*          NBPTS2      NUMBER OF ARGUMENT TWO BREAK POINTS          */
C    /*          FSCALE      SCALE FACTOR FOR FUNCTION VALUES             */
C    /*          EFLAG       ERROR CODE                                   */
C    DECLARE MVFGCM COMMON
C         1      IARRAY(512)  INTEGER
C         1      LUTBLE(3,N)  INTEGER
C         1      ENDTBL       INTEGER
C
                                        COMMON/MVFGCM/IARRAY(512),LUTBLE(3,1)
C
C    /* COMMON VARIABLES
C    /*          IARRAY      ARRAY FOR HOLDING BINARY DATA                */
C    /*          LUTBLE      LOGICAL UNIT TABLE                           */
C    /*                      N IS THE LENGTH OF THE                       */
C    /*                      TABLE AND IS SPECIFIED BY                    */
C    /*                      THE USER IN QSINC                            */
C    /*          ENDTBL      END OF LOGICAL UNIT TABLE                    */
C
C C C C C C C C C C C C C C C C C C C C C C C C C C C C C C C C C C C C C
C
                                        DIMENSION FARRAY(2,2)
                                        INTEGER QCLUI
                                        INTEGER FUNMEM,ARGMEM
C                                       MINIMUM AND MAXIMUM FUNCTION NUMBER
                                        DATA MINFNO/1/,MAXFNO/8/
C                                       MINIMUM AND MAXIMUM LENGTH
                                        DATA MINLNG/2/,MAXLNG/256/
                                        IF(EFLAG .NE. 1) GO TO 900
C    /* IF ANY OF THE CALLS TO QCFM RETURN AN ERROR, THEN EFLAG
C       IS SET EQUAL TO THE ERROR.  THE ONLY POSSIBLE ERROR IS A NON-
C       FATAL OUT OF RANGE ERROR. */
C    LOAD EVEN/EVEN MEMORY USING QCFM;
                                        CALL QCFM(LU,FARRAY,FSCALE,FUNMEM,1,
     1                                          NBPTS1,1,NBPTS2,1,0,IFLAG)
C    IF (ERROR RETURNED) THEN EFLAG = ERROR CODE;
                                        IF(IFLAG .NE. 1) EFLAG = IFLAG
C    LOAD ODD/EVEN MEMORY, USING QCFM;
                                        CALL QCFM(LU,FARRAY,FSCALE,FUNMEM+1,2,
     1                                  NBPTS1,1,NBPTS2,1,0,IFLAG)
C    IF (ERROR RETURNED) THEN EFLAG = ERROR CODE;
                                        IF(IFLAG .NE. 1) EFLAG = IFLAG
C    LOAD EVEN/ODD MEMORY, USING QCFG;
                                        CALL QCFM(LU,FARRAY,FSCALE,FUNMEM+2,1,
     1                                  NBPTS1,2,NBPTS2,1,0,IFLAG)
C    IF (ERROR RETURNED) THEN EFLAG = ERROR CODE;
                                        IF(IFLAG .NE. 1) EFLAG = IFLAG
C    LOAD ODD/ODD MEMORY, USING QCFM;
                                        CALL QCFM(LU,FARRAY,FSCALE,FUNMEM+3,2,
     1                                          NBPTS1,2,NBPTS2,1,0,IFLAG)
C    IF (ERROR RETURNED) THEN EFLAG = ERROR CODE;
                                        IF(IFLAG .NE. 1) EFLAG = IFLAG
C    END; /* THEN */
 900  CONTINUE
C    END; /* QWF2R */
                                        RETURN
                                        END
```

```
C    /* MVFG RTL SUBROUTINE TO LOAD THE FUNCTION DATA OF A FUNCTION OF
C       THREE VARIABLES, FROM A FLOATING POINT, UNSCALED ARRAY */
C    /* THE ROUTINE LOADS THE EIGHT FUNCTIONS MEMORIES IN THE FOLLOWING ORDER:
C    /*          EVEN, EVEN, EVEN                                        */
C    /*          ODD, EVEN, EVEN                                         */
C    /*          EVEN, ODD, EVEN                                         */
C    /*          ODD, ODD, EVEN                                          */
C    /*          EVEN, EVEN, ODD                                         */
C    /*          ODD, EVEN, ODD                                          */
C    /*          EVEN, ODD, ODD                                          */
C    /*          ODD, ODD, ODD                                           */
C    /* NOTE:  THE MVFG HARDWARE INDEXING STARTS WITH ZERO,
C              WHILE FORTRAN MUST START WITH ONE.  HENCE,
C              THE FORTRAN INDEX IS ONE GREATER THAN THE
C              HARDWARE INDEX.  REFERENCES TO INDICES ARE
C              TO HARDWARE ONES */
C    DECLARE QWF3R ENTRY ((*,*,*,*,*,*,*,*) INTEGER,INTEGER,REAL,INTEGER,
C                        INTEGER,INTEGER,REAL,INTEGER)
C    PROCEDURE QWF3R (LU,FNO,FARRAY,NBPTS1,NBPTS2,NBPTS3,FSCALE,EFLAG)
C
                                      SUBROUTINE QWF3R(LU,FNO,FARRAY,NBPTS1,
     1                                                 NBPTS2,NBPTS3,
     2                                                 FSCALE,EFLAG)
                                      COMMON/MVFGCM/IARRAY(512),LUTBLE(3,1)
                                      INTEGER IARRAY,LUTBLE
C
                                      INTEGER LU,FNO,NBPTS1,NBPTS2,NBPTS3
                                      INTEGER EFLAG
                                      REAL FARRAY,FSCALE
C
C    /* ARGUMENT LIST VARIABLES:                                         */
C    /*          LU          LOGICAL UNIT                                */
C    /*          FNO         FUNCTION NUMBER                             */
C    /*          FARRAY      ARRAY OF FUNCTION VALUES                    */
C    /*          NBPTS1      NUMBER OF ARGUMENT ONE BREAKPOINTS          */
C    /*          NBPTS2      NUMBER OF ARGUMENT TWO BREAKPOINTS          */
C    /*          NBPTS3      NUMBER OF ARGUMENT THREE BREAKPOINTS        */
C    /*          FSCALE      SCALE FACTOR FOR FUNCTION VALUES            */
C    /*          EFLAG       ERROR CODE                                  */
C    DECLARE MVFGCM COMMON
C          1     IARRAY(512)     INTEGER
C          1     LUTBLE(3,N)     INTEGER
C          1     ENDTBL          INTEGER
C
C    /* COMMON VARIABLES:
C    /*          IARRAY      ARRAY FOR HOLDING BINARY DATA               */
C    /*          LUTBLE      LOGICAL UNIT TABLE; N IS THE LENGTH         */
C    /*                      OF THE TABLE AND IS SPECIFIED BY            */
C    /*                      THE USER IN QSINC                           */
C    /*          ENDTBL      END OF LOGICAL UNIT TABLE                   */
C
C C C C C C C C C C C C C C C C C C C C C C C C C C C C C C C C C C C C C
C                                     FORTRAN DATA TYPES
                                      INTEGER QCLUI
C                                     FUNCTION MEMORY NUMBER
                                      INTEGER FUNMEM
C                                     ARGUMENT MEMORY NUMBER
                                      INTEGER ARGMEM
C                                     MINIMUM AND MAXIMUM FUNCTION NUMBER
                                      DATA MINFNO/1/,MAXFNO/8/
C                                     MINIMUM AND MAXIMUM ARGUMENT LENGTH
                                      DATA MINLNG/1/,MAXLNG/256/
C                                     MAXIMUM TOTAL BREAKPOINTS
                                      DATA MAXBPT/512/
                                      IF(EFLAG .NE. 1) GO TO 900
C    /* IF ANY OF THE CALLS TO QCFM RETURN AN ERROR, THEN EFLAG IS SET EQUAL
C       TO THE ERROR.  THE ONLY POSSIBLE ERROR IS A NON-FATAL OUT OF
C       RANGE ERROR */
C    LOAD EVEN/EVEN/EVEN MEMORY, USING QCFM:
                                      CALL QCFM(LU,FARRAY,FSCALE,FUNMEM,1,
     1                                          NBPTS1,1,NBPTS2,1,NBPTS3,
     2                                          IFLAG)
```

```
C    IF (ERROR RETURNED) EFLAG = ERROR CODE;
                                        IF(IFLAG .NE. 1) EFLAG = IFLAG
C    LOAD ODD/EVEN/EVEN MEMORY, USING QCFM;
                                        CALL QCFM(LU,FARRAY,FSCALE,FUNMEM+1,2,
     1                                            NBPTS1,1,NBPTS2,1,NBPTS3,
     2                                            IFLAG)
C    IF (ERROR RETURNED) EFLAG = ERROR CODE;
                                        IF(IFLAG .NE. 1) EFLAG = IFLAG
C    LOAD EVEN/ODD/EVEN MEMORY, USING QCFM;
                                        CALL QCFM(LU,FARRAY,FSCALE,FUNMEM+P,1,
     1                                            NBPTS1,2,NBPTS2,1,NBPTS3,
     2                                            IFLAG)
C    IF (ERROR RETURNED) EFLAG = ERROR CODE;
                                        IF(IFLAG .NE. 1) EFLAG = IFLAG
C    LOAD ODD/ODD/EVEN MEMORY, USING QCFM;
                                        CALL QCFM(LU,FARRAY,FSCALE,FUNMEM+3,2,
     1                                            NBPTS1,2,NBPTS2,1,NBPTS3,
     2                                            IFLAG)
C    IF (ERROR RETURNED) EFLAG = ERROR CODE;

                                        IF(IFLAG .NE. 1) EFLAG = IFLAG
C    LOAD EVEN/EVEN/ODD MEMORY, USING QCFM;
                                        CALL QCFM(LU,FARRAY,FSCALE,FUNMEM+4,1,
     1                                            NBPTS1,1,NBPTS2,2,NBPTS3,
     2                                            IFLAG)
C    IF (ERROR RETURNED) EFLAG = ERROR CODE;
                                        IF(IFLAG .NE. 1) EFLAG = IFLAG
C    LOAD ODD/EVEN/ODD MEMORY, USING QCFM;
                                        CALL QCFM(LU,FARRAY,FSCALE,FUNMEM+5,2,
     1                                            NBPTS1,1,NBPTS2,2,NBPTS3,
     2                                            IFLAG)
C    IF (ERROR RETURNED) EFLAG = ERROR CODE;
                                        IF(IFLAG .NE. 1) EFLAG = IFLAG
C    LOAD EVEN/ODD/ODD MEMORY, USING QCFM;
                                        CALL QCFM(LU,FARRAY,FSCALE,FUNMEM+6,1,
     1                                            NBPTS1,2,NBPTS2,2,NBPTS3,
     2                                            IFLAG)
C    IF (ERROR RETURNED) EFLAG = ERROR CODE;
                                        IF(IFLAG .NE. 1) EFLAG = IFLAG
C    LOAD ODD/ODD/ODD MEMORY, USING QCFM;
                                        CALL QCFM(LU,FARRAY,FSCALE,FUNMEM+7,2,
     1                                            NBPTS1,2,NBPTS2,2,NBPTS3,
     2                                            IFLAG)
                                        IF(IFLAG .NE. 1) EFLAG = IFLAG
C    END; /* THEN */
 900                                    CONTINUE
C    END; /* QWF3R */
                                        RETURN
                                        END

FORTRAN COMPILER REV. LEV. J00


C    /* MVFG RTL SUBROUTINE TO COMPUTE AND LOAD THE BINARY DATA FROM A
C       TWO OR THREE DIMENSIONAL ARRAY */
C    DECLARE QCFM ENTRY ((*,*,*,*,*,*,*,*,*,*) INTEGER,REAL,REAL,INTEGER,
C                        INTEGER,INTEGER,INTEGER,INTEGER,INTEGER,INTEGER,
C                        INTEGER)
C    PROCEDURE QCFM (LU,ARRAY,FSCALE,MEMNO,IST,IEND,JST,JEND,KST,KEND,EFLAG)
C
                                        SUBROUTINE QCFM(LU,ARRAY,FSCALE,
     1                                            MEMNO,IST,IEND,JST,JEND,
     2                                            KST,KEND,EFLAG)
                                        INTEGER EFLAG
                                        INTEGER MEMNO
                                        INTEGER LU,IST,IEND,JST,JEND,KST,KEND
                                        REAL ARRAY(2),FSCALE
C    /* ARGUMENT LIST VARIABLES:                                          */
C    /*        LU        LOGICAL UNIT                                    */
C    /*        ARRAY     ARRAY OF DATA VALUES                            */
```

```
C    /*        FSCALE     SCALE FACTOR                                  */
C    /*        MEMNO      FUNCTION MEMORY NUMBER                        */
C    /*        IST        START OF FIRST INDEX                          */
C    /*        IEND       END OF FIRST INDEX                            */
C    /*        JST        START OF SECOND INDEX                         */
C    /*        JEND       END OF SECOND INDEX                           */
C    /*        KST        START OF THIRD INDEX                          */
C    /*        KEND       END OF THIRD INDEX                            */
C    /*        EFLAG      ERROR FLAG                                    */
C
C
C    DECLARE MVFGCM COMMON
C          1    IARRAY(512)     COMMON
C          1    LUTBLE(3,N)     INTEGER
C          1    ENDTBL          INTEGER
                                     COMMON/MVFGCM/IARRAY(512),LUTBLE(3,1)
                                     INTEGER IARRAY,LUTBLE
C
C    /* COMMON VARIABLES:                                               */
C    /*        IARRAY     ARRAY FOR BINARY DATA                         */
C    /*        LUTBLE     LOGICAL UNIT TABLE                            */
C    /*                   N IS THE LENGTH                               */
C    /*                   OF THE TABLE                                  */
C    /*        ENDTBL     END OF LOGICAL UNIT TABLE                     */
C
C C C C C C C C C C C C C C C C C C C C C C C C C C C C C C C C C C C C C
C
C    /*   QCFM IS CALLED FROM QWF2R,QWF2S,QWF3R AND QWF3S. */
C    /* IT LOADS THE COMMON ARRAY WITH THE SCALED VALUES, STARTING
C       WITH (IST,JST,KST). */
C    /* THE FIRST INDEX CHANGES MOST RAPIDLY, THE SECOND NEXT, AND
C       THE THIRD INDEX THE MOST SLOWLY. */
C    /* EACH INDEX IS INCREMENTED BY TWO. */
C    /* ARRAY IS TREATED AS A ONE DIMENSIONAL ARRAY, BUT MAY REFERENCI
C       A TWO OR THREE DIMENSIONAL ARRAY.  IEND AND/OR JEND ARE USED
C       TO INDEX THROUGH ARRAY. */
C    /* IN THE MVFG MEMORIES, EACH MEMORY MUST LINE UP WITH THE OTHERS.
C       HENCE, DUMMY VALUES MAY NEED TO BE ADDED FOR CERTAIN INDICES.
C       THAT IS, FOR EACH SECOND INDEX, THE SAME NUMBER OF FIRST INDICES
C       MUST BE LOADED.  IF NOT, ONE DUMMY VALUE MUST BE LOADED.  FOR
C       EACH THIRD INDEX, THE SAME NUMBER OF FIRST AND SECOND INDICES
C       MUST BE LOADED.  IF NOT, THE SAME NUMBER OF DUMMY VALUES AS
C       FIRST INDICES NEEDS TO BE LOADED.  HOWEVER, DUMMY VALUES AT
C       THE END OF A MEMORY NEED NOT BE LOADED. */
C
C C C C C C C C C C C C C C C C C C C C C C C C C C C C C C C C C C C C C
C
C                                    FORTRAN DATA TYPES
C
C                                    MAXIMUM SCALED VALUE
C                                    DATA AMAX/.99999/
C
C C C C C C C C C C C C C C C C C C C C C C C C C C C C C C C C C C C C C
C
C    BEGIN; /* QCFM */
C
C    INITIALIZE IFLAG TO 1
C    INITIALIZE KNT TO 0; /* COUNTER IN IARRAY */
                                     KNT = 0
C    INITIALIZE K TO KST; /* THIRD INDEX */
C
C    DO WHILE (K < KEND);
C
C        INCREMENT K BY 2;
                                     DO 599 K=KST,KEND,2
C         INITIALIZE J TO JST
C
C         DO WHILE (J < JEND); /* SECOND INDEX */
C
C              INCREMENT J BY 2;
                                     DO 499 J = JST,JEND,2
```

```
C               INITTALIZE I TO IST;
C
C               DO WHILE (I < IEND); /* FIRST INDEX */
C
C                    INCREMENT I BY 2;
                                  DO 399 I=IST,IEND,2
C                    KNT = KNT+1;
                                  KNT = KNT+1
C                    COMPUTE INDEX INTO ARRAY;
C                                       K=OFFSET            J=OFFSET
                                  L=(JEND*IEND)*(K-1)+IEND*(J-1)+I
C                    SCALE VALUE WITH USER'S SCALE FACTOR;
                                  ATEMP = ARRAY(L)/FSCALE
C                    IF (OVER SCALE)
                                  IF( ABS(ATEMP) .LE. AMAX) GO TO 350
C                         THEN BEGIN;
C                         IFLAG = 14; /* NOT FATAL */
                                  IFLAG = 14
C                         PUT FULL SCALE IN BINARY ARRAY;
                                  IARRAY(KNT)=SIGN(32767.,ATEMP)
C                         END; /* THEN */
                                  GO TO 370
C                         ELSE BEGIN;
 350                              CONTINUE
C                         SCALE TO FORM 16 BIT INTEGER;
C                         PUT IN BINARY ARRAY;
                                  IARRAY(KNT)=ATEMP*32767.
C                         END; /* ELSE */
C               END; /* DO WHILE (I) */
 370                              CONTINUE
 399                              CONTINUE
C               IF (NOT ENOUGH I'S LOADED) THEN INCREMENT KNT BY 1;
                                  IF(((IEND-IST)/2+1).EQ.((IEND-1)/2+1))
     1                                 GO TO 440
                                  KNT=KNT+1
C                    /* DUMMY VALUES */
                                  IARRAY(KNT)=0
 440                              CONTINUE
C          END; /* DO WHILE (J) */
 499                              CONTINUE
C          IF (NOT ENOUGH J'S LOADED) THEN INCREMENT KNT BY THE NUMBER OF
C                    I'S LOADED; /* DUMMY VALUES */
                                  IF(((JEND-JST)/2+1).EQ.((JEND-1)/2+1))
     1                                 GO TO 540
                                  MST=KNT+1
                                  KNT=KNT+(IEND-1)/2+1
                                  DO 520 M=MST,KNT
                                  IARRAY(M)=0
 520                              CONTINUE
 540                              CONTINUE
C    END; /* DO WHILE (K) */
 599                              CONTINUE
C    LOAD FUNCTION MEMORY MEMNO, LENGTH KNT, USING QWFMB;
                                  CALL QWFMB(LU,MEMNO,IARRAY,KNT,EFLAG)
C    SET EFLAG;
                                  EFLAG = IFLAG
C    END; /* QCFM */
                                  RETURN
                                  END
C    /* MVFG RTL SUBROUTINE TO LOAD THE ARGUMENT DATA FROM A FLOATING
C    /* POINT, UNSCALED ARRAY */
C    /* THE ROUTINE 1) CHECKS FOR ERRORS;          */
C    /* 2) LOADS THE ARGUMENT MEMORY; AND          */
C    /* 3) LOADS THE DIFFERENCE MEMORY             */
C    DECLARE QWARGR ENTRY ((*,*,*,*,*,*,*) INTEGER, INTERGER, INTERGER,
C         REAL, INTEGER, REAL, INTEGER)
C    PROCEDURE QWARGR (LU, FNO, ARGNO, ARRAY, LENGTH, SCALE, EFLAG)
                                  SUBROUTINE QWARGR(LU,FNO,ARGNO,ARRAY,
     1                                      LENGTH,SCALE,EFLAG)
                                  INTEGER LU,FNO,ARGNO,LENGTH,EFLAG
                                  REAL     ARRAY(2),SCALE
```

```
C    /* ARGUMENT LIST VARIABLES : */
C    /* LU      LOGICAL UNIT NUMBER */
C    /* FNO     FUNCTION NUMBER */
C    /* ARGNO   ARGUMENT NUMBER OF THE FUNCTION */
C    /* ARRAY   ARRAY OF ARGUMENT VALUES */
C    /* LENGTH  NUMBER OF BREAKPOINTS = LENGTH OF ARRAY */
C    /* SCALE   SCALE FACTOR FOR ARGUMENT DATA */
C    /* EFLAG   ERROR CODE */
C    DECLARE MVFGCM COMMON
C         1 IARRAY (512)       INTEGER
C         1 LUTBLE (3,N)       INTEGER
C         1 ENDTBLE       INTEGER
                                   COMMON/MVFGCM/IARRAY(512),LUTBLE(3,1)
                                   INTEGER IARRAY, LUTBLE
C    /* COMMON VARIABLES: */
C    /* IARRAY ARRAY FOR BINARY DATA */
C    /* LUTBLE LOGICAL UNIT TABLE = */
C         /* N IS THE LENGTH OF THE TABLE AND IS SPECIFIED BY */
C         /* THE USER IN QSINC */
C    /* ENDTBL END OF LOGICAL UNIT TABLE */
C
C C C
```

```
C                    IF(OVER SCALE)
                          IF(ABS(ATEMP/SCALE).LE.AMAX)GO TO 230
C                    THEN BEGIN;
C                          EFLAG=14; /* NOT A FATAL ERROR */
                           EFLAG = 14
C                          SET ELEMENT TO FULL SCALE;
                           IARRAY(1)=SIGN(32767.,ATEMP/SCALE)
C                          END; /* THEN */
                           GO TO 240
C                    ELSE BEGIN;
 230                       CONTINUE
C                          SCALE VALUE BY USER'S SCALE FACTOR;
C                          SCALE TO 16 BIT INTEGER FORM;
C                          PUT SCALED VALUE IN BINARY ARRAY;
                           IARRAY(1) = (ATEMP/SCALE)*32767.
C                          END; /* ELSE */
 240                       CONTINUE
C                    END; /* SCALE */
C
C
C                /* LOAD REST OF ELEMENTS, TWICE EACH */
C
C                DO WHILE (EVEN INDEXED ELEMENTS REMAIN)
                           DO 290 I = 3, LENGTH,2
C                    PUT NEXT EVEN INDEXED ELEMENT IN ATEMP;
                           ATEMP = ARRAY(I)
C                    PERFORM SCALE (INDEX INTO BINARY ARRAY);
C
C                          /* SCALE AND TEST A VALUE */
C                          DECLARE SCALE ENTRY ((*)INTEGER)
C                          PROCEDURE SCALE (INDEX)
C                          /* THIS PROCEDURE, INTERNAL TO QWAIGR,
C                            SCALES THE VALUE IN ATEMP BY THE
C                            USER'S SCALE FACTOR AND SCALES TO
C                            MAKE IT A 16 BIT INTEGER */
C                          /* IF OVER SCALE, IT PUTS IN FULL SCALE */
C                          /* THE SCALED VALUE IS LEFT IN THE
C                            BINARY DATA ARRAY, AT INDEX I */
C                          BEGIN; /* SCALE */
C                     IF(OVER SCALE)
                           IF(ABS(ATEMP/SCALE).LE.AMAX)GO TO 260
C                          THEN BEGIN;
C                               EFLAG=14; /* NOT A FATAL ERROR */
                           EFLAG = 14
C                               SET ELEMENT TO FULL SCALE;
                           IARRAY(I-1)=SIGN(32767.,ATEMP/SCALE)
C                               END; /* THEN */
                           GO TO 270
C                          ELSE BEGIN;
 260                       CONTINUE
C                               SCALE VALUE BY USER'S SCALE FACTOR;
C                               SCALE TO 16 BIT INTEGER FORM;
C                               PUT SCALED VALUE IN BINARY ARRAY;
                           IARRAY(I-1) =(ATEMP/SCALE)*32767.
C                               END; /* ELSE */
 270                       CONTINUE
C                          END; /* SCALE */
C
C
C                    PUT VALUE IN BINARY ARRAY SECOND TIME;
                           IARRAY(I) = IARRAY(I-1)
C                /* END; /* DO WHILE */
 290                       CONTINUE
C                COMPUTE ADJUSTED LENGTH;
                           NLNGTH = LENGTH - 1
C                LOAD BINARY DATA INTO ARGUMENT MEMORY, WITH QWAMB;
                           CALL QWAMB(LU,ARGMEM,IARRAY,NLNGTH,
     1                                EFLAG)
C
C                /* END; /* LOAD-ARG */
C
C            PERFORM LOAD-DIFF; /* COMPUTE AND LOAD BINARY DIFFERENCE DATA */
C
```

```
C                    PROCEDURE LOAD-DIFF
C                    /* PROCEDURE INTERNAL TO QWARGR TO COMPUTE AND LOAD
C                       THE DIFFERENCE MEMORY */
C                    /* THE DIFFERENCES ARE COMPUTED, SCALED, AND PUT
C                       IN THE COMMON ARRAY */
C
C                    BEGIN; /* LOAD-DIFF */
C
C                    DO WHILE (ELEMENTS REMAIN AND NO FATAL ERRORS)
C                                   INITIALIZE LOOP
                                    I = 0
C                                   INCREMENT AND TEST LOOP
 300                                CONTINUE
                                    I = I + 1
                                    IF((I .GE. LENGTH) .OR.
     1                                ((EFLAG.NE. 1) .AND.
     2                                 (EFLAG.NE.14))) GO TO 370
C                        COMPUTE DIFFERENCE;
                                    DIFF = (ARRAY(I+1)-ARRAY(I))/SCALE
C                        IF (NOT ORDERED)
                                    IF(DIFF .GE. 0.) GOTO 320
C                             THEN EFLAG = 9;
                                    EFLAG = 9
                                    GO TO 360
C                             ELSE BEGIN;
 320                                CONTINUE
C                                   IF (OVER SCALE)
                                    IF(DIFF .LE. AMAX) GO TO 310
C                                        THEN EFLAG = 15;
                                    EFLAG = 15
                                    GO TO 350
C                                        ELSE BEGIN;
 310                                CONTINUE
C                                              SCALE THE DIFFERENCE;
C                                              PUT DIFFERENCE IN BINARY ARRAY;
                                    IARRAY(I)=DIFF*32767.
C                                              IF(EITHER ARGUMENT VALUE)
C                                                OVER SCALE)
                                    IF((ABS(ARRAY(I)/SCALE).LE.1.) .AND.
     1                                (ABS(ARRAY(I+1)/SCALE).LE.1.))
     2                                GOTO 340
C                                                   THEN DIFFERENCE = 3;
                                    IARRAY(I) = 3
C                                              END; /* ELSE */
 340                                CONTINUE
350                                 CONTINUE
 360                                CONTINUE
C                    END; /* DO WHILE */
                                    GO TO 300
 370                                CONTINUE
C                    IF (NO FATAL ERRORS ) THEN BEGIN
                                    IF((EFLAG .NE. 1) .AND.
     1                                   (EFLAG .NE. 14))GO TO 390
C                        LOAD DIFFERENCE MEMORY, WITH QWDMB;
                                    CALL QWDMB(LU,ARGMEM,IARRAY,NLNGTH,
     1                                         IFLAG)
C                        IF(ERROR RETURNED) THEN SET EFLAG;
                                    IF(IFLAG.NE.1)EFLAG = IFLAG
C                        END; /* THEN */
 390                                CONTINUE
C
C                    END; /* LOAD-DIFF */
C
C              END; /*THEN*/
900                                 CONTINUE
C   END; /* QWARGR */
                                    RETURN
                                    END
C   /* AVFG RTL SUBROUTINE TO LOAD THE FUNCTION DATA OF A FUNCTION OF ONE */
C   /* VARIABLE, FROM A FLOATING POINT, UNSCALED ARRAY */
```

```
C    /* THE ROUTINE 1) CHECKS FOR ERRORS */
C    /*             2) LOADS THE EVEN INDEXED VALUES, AND */
C    /*             3) LOADS THE ODD INDEXED VALUES */
C    /* NOTE: THE MVFG HARDWARE INDEXING STARTS WITH ZERO, WHILE FORTRAN */
C    /* MUST START WITH ONE. HENCE, THE FORTRAN INDEX IS ONE GREATER THAN */
C    /* THE HARDWARE INDEX. REFERENCES TO INDICES ARE TO HARDWARE ONES. */
C    DECLARE QWF1R ((*,*,*,*,*,*) INTEGER, INTEGER, REAL, INTEGER, REAL INTEGER)
C    PROCEDURE QWF1R (LU, FNO, FARRAY, NBPTS, FSCALE, EFLAG)
                                    SUBROUTINE QWF1R(LU,FNO,FARRAY,LENGTH,
     1                                          FSCALE,EFLAG)
                                    INTEGER LU,FNO,LENGTH,EFLAG
                                    REAL FARRAY(2),FSCALE
C    /* ARGUMENT LIST VARIABLES */
C    /*        LU          LOGICAL UNIT NUMBER */
C    /*        FNO         FUNCTION NUMBER */
C    /*        FARRAY      ARRAY OF FUNCTION VALUES */
C    /*        NBPTS       NUMBER OF BREAK POINTS */
C    /*        FSCALE      SCALE FACTOR FOR FUNCTION VALUES */
C    /*        EFLAG       ERROR CODE */
C    DECLARE MVFGCM COMMON
C         1 IARRAY(512)  INTEGER
C         1 LUTBLE(3,N)  INTEGER
C         1 ENDTBL       INTEGER
                                    COMMON/MVFGCM/IARRAY(512),LUTBLE(3,1)
                                    INTEGER IARRAY, LUTBLE
C    /* COMMON VARIABLES */
C    /*  IARRAY          ARRAY FOR HOLDING BINARY DATA */
C    /*  LUTBLE          LOGICAL UNIT TABLE */
C    /*                  N IS THE LENGTH OF THE TABLE AND */
C    /*                  IS SPECIFIED BY THE USER IN QSINC */
C    /*  ENDTBL          END OF LOGICAL UNIT TABLE */
C
C C C C C C C C C C C C C C C C C C C C C C C C C C C C C C C C C C C C C C C C C C
C
C                                   FORTRAN DATA TYPE DECLARATION
C
                                    INTEGER QCDFI,QCLUI
                                    INTEGER FUNMEM,ARGMEM
C                                   MINIMUM AND MAXIMUM FUNCTION NUMBER
                                    DATA MINFNO/1/,MAXFNO/8/
C                                   MINIMUM AND MAXIMUM LENGTH
                                    DATA MINLNG/2/,MAXLNG/256/
C                                   MAXIMUM SCALED DATA VALUE
                                    DATA AMAX/.99999/
        C
        C        PERFORM   LOAD-FUNC-MEM(1,MEMORY NUMBER); /* EVEN */

C
C              /* LOAD A FUNCTION MEMORY FOR QWF1R */
C              /* INTERNAL PROCEDURE TO SCALE AND LOAD ONE FUNCTION MEMORY */
C              /* THE ARGUMENTS SPECIFY THE STARTING ELEMENT AND WHICH
C                 FUNCTION MEMORY */
C              DECLARE LOAD-FUNC-MEM ENTRY((*,*) INTEGER, INTEGER)
C              PROCEDURE LOAD-FUNC-MEM(FIRST, FUNC NO)
C
C              BEGIN;  /* LOAD-FUNC-MEM */
C
C              /* LOAD EVERY OTHER DATA VALUE, STARTING WITH FIRST INTO THE
C                 COMMON ARRAY */
C              DO WHILE (ELEMENTS REMAIN IN ARRAY)
                                    DO 270 I = 1,LENGTH,2
C                 GET NEXT ELEMENT;
                                    K = (I+1)/2
C                 IF (OVER SCALE)
                                    IF(ABS(FARRAY(I)/FSCALE).LE.AMAX)
     1                              GO TO 250
C                      THEN BEGIN;
C                           EFLAG = 14; /* NOT A FATAL ERROR */
                                    EFLAG = 14
C                           PUT FULL SCALE IN BINARY ARRAY;
                                    IARRAY(K)=SIGN(32767.,
     1                              FARRAY(I)/FSCALE)
```

```
C                                   END; /* THEN */
                                          GO TO 260
C                             ELSE BEGIN;
 250                                      CONTINUE
C                                   SCALE VALUE USING USER SCALE FACTOR;
C                                   SCALE TO FORM 16 BIT SCALED INTEGER;
C                                   PUT IN BINARY ARRAY;
                                          IARRAY(K)=(FARRAY(I)/FSCALE)*32767.
C                                   END; /* ELSE */
 260                                      CONTINUE
C                   END; /* DO WHILE */
 270                                      CONTINUE
C                   COMPUTE LENGTH
                                          NLNGTH = (LENGTH +1)/2
C                   LOAD FUNCTION MEMORY,FUNCNO, WITH QWFMB;
                                          CALL QWFMB(LU,FUNMEM,IARRAY,NLNGTH,
     1                                              EFLAG)
C
C                   END; /* LOAD-FUNC-MEM */
C
C              PERFORM   LOAD-FUNC-MEM(2,MEMORY NUMBER +1); /* ODD */
C
C                   /* LOAD-FUNC-MEM */
C                   /* INTERNAL PROCEDURE TO SCALE AND LOAD ONE FUNCTION MEM */
C                   /* THE ARGUMENTS SPECIFY THE STARTING ELEMENT AND WHICH
C                   /* FUNCTION MEMORY */
C                   DECLARE LOAD-FUNC-MEM((*,*)INTEGER,INTEGER)
C                   PROCEDURE LOAD-FUNC-MEM(FIRST,FUNCNO)
C
C                   BEGIN; /* LOAD-FUNC-MEM */
C
C                   /* LOAD EVERY OTHER DATA VALUE, STARTING WITH FIRST,INTO
C                   /* THE COMMON ARRAY */
C                   DO WHILE (ELEMENTS REMAIN IN ARRAY);
                                          DO 370 I=2,LENGTH,2
C                        GET NEXT ELEMENT;
                                          K=I/2
C                        IF (OVER SCALE)
                                          IF(ABS(FARRAY(I)).LE. AMAX) GO TO 350
C                             THEN BEGIN;
C                                   EFLAG=14; /* NOT A FATAL ERROR */
                                          EFLAG = 14
C                                   PUT FULL SCALE IN BINARY ARRAY;
                                          IARRAY(K) = SIGN(32767.,
     1                                         FARRAY(I)/FSCALE)
C                                   END; /* THEN */
                                          GO TO 360
C                             ELSE BEGIN;
 350                                      CONTINUE
C                                   SCALE VALUE WITH USER SCALE FACTOR;
C                                   SCALE TO FORM 16 BIT SCALED INTEGER;
C                                   PUT IN BINARY ARRAY;
                                          IARRAY(K)=(FARRAY(I)/FSCALE)*32767.
C                                   END; /*ELSE*/
 360                                      CONTINUE
C                   END; /* DO WHILE*/
 370                                      CONTINUE
C                   LOAD FUNCTION MEMORY, FUNCNO, WITH QWFMB;
                                          IFNMEM = FUNMEM + 1
                                          CALL QWFMB(LU,IFNMEM,IARRAY,
     1                                         NLNGTH,IFLAG)
C
C                             IF(ERROR RETURNED) THEN SET EFLAG;
                                          IF(IFLAG.NE.1)EFLAG = IFLAG
C
C                   END; /*LOAD-FUNC-MEM*/
C
C              END;        /* THEN */
 900                                      CONTINUE
C   END;                /* QWFIR */
                                          RETURN
                                          END
```

```
C    /* MVFG RTL SUBROUTINE TO LOAD THE BINARY ARGUMENT DATA */
C    DECLARE QWAMB ENTRY ((*,*,*,*,*) INTEGER,INTEGER,INTEGER,INTEGER,INTEGER)
C    PROCEDURE QWAMB (LU,MEMNO,BARRAY,LENGTH,EFLAG)
                                        SUBROUTINE QWAMB(LU,MEMNO,BARRAY,
     1                                                  LENGTH,EFLAG)
                                        DIMENSION BARRAY(2)
                                        INTEGER LU,MEMNO,BARRAY,LENGTH,EFLAG
C    /* ARGUMENT LIST VARIABLES: */
C    /* LU          LOGICAL UNIT */
C    /* MEMNO       ARGUMENT MEMORY NUMBER */
C    /* BARRAY      ARRAY OF BINARY DATA */
C    /* LENGTH      NUMBER OF VALUES TO BE LOADED */
C    /* EFLAG       ERROR CODE */
C
C    DECLARE MVFGCM COMMON
C              1 IARRAY(512)  INTEGER
C              1 LUTBLE(3,N)  INTEGER
C              1 ENDTBL       INTEGER
C
C    /* COMMON VARIABLES:  */
C    /*   IARRAY  ARRAY FOR BINARY DATA  */
C    /*   LUTBLE  LOGICAL UNIT TABLE
C                 N IS THE LENGTH OF THE TABLE AND IS
C                 SPECIFIED BY THE USER IN QSINC  */
C    /*           LUTBLE(3,-) = 256*X-EXTENT + Y-EXTENT  */
C    /*   ENDTBL  END OF LOGICAL UNIT TABLE  */
C
C
                                        COMMON /MVFGCM/IARRAY(512),LUTBLE(3,1)
                                        INTEGER IARRAY,LUTBLE
C
C C C C C C C C C C C C C C C C C C C C C C C C C C C C C C C C C C C C C C
C
C    DECLARE ARGTBL(8) INTEGER /* ARG MEMORY ADDRESSES */
C         INITIALIZE ('1,'5,'11,'15,'21,'25,'31,'35)
                                        INTEGER ARGTBL(8)
C    DECLARE XTNT(3)   INTEGER /* EXTENT REGISTER ADDRESSES */
C         INITIALIZE('3,'7,'13)
                                        INTEGER XTNT(3)
C    DECLARE TBLBPR(8) INTEGER /* BREAK POINT REGISTER ADDRESSES */
C         INITIALIZE('2,'6,'10,'14,'22,'26,'32,'36)
                                        INTEGER TBLBPR(8)
C
C                                       FORTRAN DATA TYPE STATEMENTS
C
                                        INTEGER QCDFI,QCLUI
                                        INTEGER DFWORD
                                        INTEGER STATUS
                                        INTEGER RVALUE
                                        INTEGER BITNO
                                        INTEGER XT1,XT2
C                                       MINIMUM AND MAXIMUM MEMORIES
                                        DATA MINMEM/1/,MAXMEM/8/
C                                       MINIMUM AND MAXIMUM LENGTHS
                                        DATA MINLNG/1/,MAXLNG/255/
C                                       STATUS BIT FOR MODULE NON-EXISTENT
                                        DATA BITNO/0/
C
                                        DATA ARGTBL/1,5,9,13,17,21,25,29/
                                        DATA XTNT/3,7,11/
                                        DATA TBLBPR/2,6,10,14,18,22,26,30/
                                        IF(EFLAG .NE. 1) GO TO 900
C         /* MEMORY ADDRESS ALREADY SELECTED */
C
C         /* LOAD DATA VALUES */
C
C         ITERATIVE DO I=1,LENGTH
                                        DO 250 I=1,LENGTH
C              GET NEXT VALUE:
                                        ITEMP=BARRAY(I)
C              IF(VALUE NEGATIVE)
                                        IF(ITEMP .GE. 0) GO TO 240
```

```
C                    THEN MAKE TWO'S COMPLEMENT IN 12 BIT WORD
                                    IF(ITEMP.LE.-32751)GO TO 230
                                    ITEMP = ITEMP + 16
                                    GO TO 245
 230                                CONTINUE
                                    ITEMP = -32767
 245                                CONTINUE
 240                                CONTINUE
C              LOAD VALUE WITH QWMDOC;
                                    CALL QWMDOC(ITEMP,1,EFLAG)
C          END; /* DO */
 250                                CONTINUE
C          GET BREAKPOINT MAXIMUM REGISTER FROM TBLBPR;
C          GET DFWORD WITH QCDFI;
                                    DFWORD = QCDFI(LU,TBLBPR(MEMNO))
C          ADDRESS REGISTER WITH QWMDFCS
                                    CALL QWMDFC(DFWORD)
C          COMPUTE BPR VALUE;
                                    RVALUE = LENGTH -1
C          LOAD REGISTER USING QWMDOC;
                                    CALL QWMDOC(RVALUE,1,EFLAG)
C
C          IF(FUNCTION OF MORE THAN ONE VARIABLE) THEN BEGIN;
C
                                    IF((MODE .EQ. 1) .OR.
     1                                   ((MODE .EQ. 3) .AND.
     2                                   ((MEMNO .EQ. 1) .OR.
     3                                   (MEMNO .EQ. 2)))) GO TO 890
C
C              IF(FUNCTION OF TWO VARIABLES)
C
                                    IF(MODE.EQ.4)GO TO 300
C                    THEN BEGIN;
C                         IF(FIRST ARGUMENT)
C                         THEN BEGIN;
                                    IF((MEMNO.EQ.2).OR.(MEMNO.EQ.4))
     1                                   GO TO 280
C                         COMPUTE EXTENT;
                                    XT1 = (LENGTH + 2)/2
C                         GET EXTENT REGISTER ADDRESS;
                                    DFWORD = QCDFI(LU,XTNT(MEMNO))
C                         GET DF WORD USING QWMDFC;
                                    CALL QWMDFC(DFWORD)
C                         LOAD EXTENT, USING QWMDOC;
                                    CALL QWMDOC(XT1, 1, EFLAG)
C                         END;  /*THEN*/
 280                                CONTINUE
C                         END; /* THEN */
                                    GO TO 880
C
C                    ELSE BEGIN; /* FUNCTION OF 3 VARIABLES */
C
 300                                CONTINUE
C                         /* GET EXTENTS ALREADY IN TABLE */
C                         REPEAT;
                                    I = 1
 310                                CONTINUE
C                              GET LOGICAL UNIT ENTRY;
C                         UNTIL(LOGICAL UNIT MATCHES LU);
                                    IF( LUTBLE(1,I) .EQ. LU) GO TO 320
                                    I = I+1
                                    GO TO 310
 320                                CONTINUE
C                         COMPUTE FIRST EXTENT IN TABLE;
                                    XT1 = LUTBLE(3,I)/129
C                         COMPUTE SECOND EXTENT IN TABLE;
                                    XT2 = LUTBLE(3,I)-XT1*129
C
C                         SELECT(MEMORY NUMBER);
                                    KASE = MEMNO
                                    IF( (KASE.LT.1) .OR.
     1                                   (KASE.GT.2)) KASE = 3
```

```
                                    GO TO (330,370,390),KASE
C                                CASE(1): /* FIRST ARGUMENT */
 330                                CONTINUE
C                                   COMPUTE FIRST EXTENT;
                                    XT1 = (LENGTH + 2)/2
C                                   PUT VALUE IN TABLE;
                                    LUTBLE(3,I) = 129*XT1+XT2
C                                   GET EXTENT REGISTER ADDRESS FROM XTNT;
C                                   FORM DF WORD USING QCDFI;
                                    DFWORD = QCDFI(LU,XTNT(1))
C                                   SELECT REGISTER USING QWMDFC;
                                    CALL QWMDFC(DFWORD)
C                                   LOAD REGISTER USING QWMDOC;
                                    CALL QWMDOC(XT1, 1, EFLAG)
C                                   IF(SECOND EXTENT IN TABLE);
                                    IF(XT2 .EQ. 0) GO TO 360
C                                        THEN BEGIN; /* LOAD Y EXTENT */
                                    RVALUE = XT1 * XT2
C                                            GET REGISTER ADDRESS FROM XTNT;
                                    DFWORD = QCDFI(LU,XTNT(2))
C                                            SELECT REGISTER USING QWMDFC;
                                    CALL QWMDFC(DFWORD)
                                    CALL QWMDOC(RVALUE, 1, EFLAG)
C                                            END; /* THEN */
 360                                CONTINUE
                                    GO TO 395
C
C
C                                CASE(2): /* SECOND ARGUMENT */
 370                                CONTINUE
C                                   COMPUTE Y EXTENT;
                                    XT2 = (LENGTH +1)/2
C                                   PUT EXTENTS IN LUTBLE;
                                    LUTBLE(3,I) = 129*XT1+XT2
C                                   IF(FIRST EXTENT IN TABLE) THEN;
                                    IF(XT1 .EQ. 0) GO TO 375
C                                        COMPUTE VALUE;
                                    RVALUE = XT1 * XT2
C                                        GET REGISTER ADDRESS FROM XTNT;
C                                        GET DF WORD USING QCDFI;
                                    DFWORD = QCDFI(LU,XTNT(2))
C                                        SELECT REGISTER USING QWMDFC;
                                    CALL QWMDFC(DFWORD)
C                                        LOAD VALUE USING QWMDOC;
                                    CALL QWMDOC(RVALUE, 1, EFLAG)
C                                        END; /* THEN */
 375                                CONTINUE
                                    GO TO 395
C
C                                CASE(3): /* DEFAULT */
 390                                CONTINUE
C
C                                ENDSELECT;
 395                                CONTINUE
C                            END; /* ELSE */
 880                                CONTINUE
 890                                CONTINUE
C                 END; /* THEN */
 900                                CONTINUE
C    END; /* QWAMB */
                                    RETURN
                                    END

C    /* HVFG RTL SUBROUTINE TO LOAD THE BINARY DIFFERENCE DATA */
C    DELCARE QWDMB ENTRY(*,*,*,*,*)  INTEGER,INTEGER,INTEGER,INTEGER,INTEGER)
C    PROCEDURE QWDMB(LU,DIFMEM,BARRAY,LENGTH,EFLAG)
                                    SUBROUTINE QWDMB(LU,DIFMEM,BARRAY,
     1                                                LENGTH,EFLAG)
                                    DIMENSION BARRAY(2)
                                    INTEGER LU,DIFMEM,BARRAY,LENGTH,EFLAG
C    /* ARGUMENT LIST VARIABLES: */
```

```
C    /* LU            LOGICAL UNIT */
C    /* DIFMEM        DIFFERENCE MEMORY TO BE LOADED */
C    /* BARRAY        ARRAY OF BINARY DATA */
C    /* LENGTH        THE NUMBER OF VALUES TO BE LOADED */
C    /* EFLAG         ERROR CODE */
C
C C C
```

```
C    DECLARE FUNTBL(16) INTEGER
C         INITIALIZE ('40,'41,'42,'43,'44,'45,'46,'47,'50,'51,'52,'53,'54,
C              '55,'56,'57)
C    /* IN FUNTBL, THE INDEX IS THE FUNCTION MEMORY NUMBER, AND THE */
C    /* VALUE IS THE ASSOCIATED MEMORY ADDRESS */
                                        DATA FUNTBL/32,33,34,35,36,37,38,39,
     1                                          40,41,42,43,44,45,46,47/
C                                       MINIMUM AND MAXIMUM LENGTH
                                        DATA MINLNG/1/,MAXLNG/511/
C                                       MINIMUM AND MAXIMUM MEMORY NUMBER
                                        DATA MINMEM/1/,MAXMEM/16/
C                                       STATUS BIT FOR MODULE NON EXISTANT
                                        DATA BITNO/0/
C                                       STATUS WORD FOR SVFG
                                        DATA STSV/1/
C                                       STATUS WORD FOR MVFG
                                        DATA STMV/2/
C                                       STATUS WORD FOR EXPANDED MVFG
                                        DATA STEX/4/
C
                                        IF( EFLAG .NE. 1) GO TO 900
C         /* MEMORY ADDRESS ALREADY SELECTED */
C         /* LOAD DATA VALUES */
C         ITERATIVE DO I=1, LENGTH
                                        DO 250 I=1,LENGTH
C              GET NEXT DATA VALUE;
                                        ITEMP=BARRAY(I)
C
C         /* MODIFY DATA VALUES TO MAKE SIGN/MAGNITUDE NUMBERS */
C
C              IF(VALUE LESS THAN ZERO)
                                        IF(ITEMP .GE. 0) GO TO 240
C                   THEN BEGIN;
C                        IF(VALUE IS -32767)
                                        IF(ITEMP .NE.-32767) GO TO 220
C                             THEN MAKE -1;
                                        ITEMP=-1
                                        GO TO 230
C                             ELSE MAKE SIGN/MAGNITUDE;
 220                                    CONTINUE
                                        ITEMP=((ITEMP*(-1))+1)-32767
 230                                    CONTINUE
C                        END; /* THEN */
 240                                    CONTINUE
C              LOAD VALUE USING DWMDOC;
                                        CALL DWMDOC(ITEMP,1,EFLAG)
C         END; /* DO */
 250                                    CONTINUE
C         END; /* THEN */
900                                     CONTINUE
C    END; /* DWFMR */
                                        RETURN
                                        END

C    /* MVFG RTL SUBROUTINE TO INITIALIZE THE LOGICAL UNIT TABLE */
C    /* THIS ROUTINE MUST BE CALLED FIRST */
C    DECLARE DSINC ENTRY ((*,*) INTEGER, INTEGER)
C    PROCEDURE DSINC (LLUT,EFLAG)
                                        SUBROUTINE DSINC(LLUT,EFLAG)
                                        INTEGER LLUT,EFLAG
C    /* ARGUMENT LIST VARIABLES */
C    /* LLUT  LENGTH OF LOGICAL UNIT TABLE */
C    /* EFLAG  ERROR CODE */
C    DECLARE          MVFGCM          COMMON
C                     1 IARRAY(512)   INTEGER
C                     1 LUTBLE(3,N)   INTEGER
C                     1 ENDTBL        INTEGER
                                        COMMON/MVFGCM/IARRAY(512),LUTBLE(3,1)
                                        INTEGER IARRAY,LUTBLE
C    /* COMMON VARIABLES: */
C    /* IARRAY       ARRAY FOR BINARY DATA */
```

```
C    /* LUTABLE      LOGICAL UNIT TABLE
C                   N IS THE LENGTH OF THE TABLE AND
C                   IS SPECIFIED BY THE USER IN QSINC */
C    /* ENDTBL       END OF LOGICAL UNIT TABLE */
C    /* IN THE LOGICAL UNIT TABLE */
C    /* LUTBLE(1,-) IS THE LOGICAL UNIT NUMBER */
C    /* LUTBLE(2,-) HAS RACK/MODULE/MODE */
C    /* LUTBLE(3,-) HAS X AND Y EXTENTS */
C    /* QSINC INITIALIZES LUTBLE(1,-) TO ZERO AND ENDTBL TO -1 */
C


C         DO I=1, LENGTH OF TABLE
                                        DO 250 I = 1,LLUT
C              CLEAR LOGICAL UNIT NUMBER TABLE ENTRY;
                                        LUTBLE(1,I) = 0.
C         END; /* DO */
 250                                    CONTINUE
C         INITIALIZE END OF TABLE;
                                        LUTBLE(1,LLUT+1) = -1
C         END; /* THEN */
 900                                    CONTINUE
C    END; /* QSINC */


                                           RETURN
                                           END

C    /* MVFG RTL SUBROUTINE TO ASSIGN A LOGICAL UNIT TO A SPECIFIC */
C    /* RACK/MODULE AND SET MODE */
C    DECLARE QSASC ENTRY ((*,*,*,*,*) INTEGER,INTEGER,INTEGER,INTEGER,INTEGER)
C    PROCEDURE QSASC (LU,RACK,MODULE,MODE,EFLAG)
                                        SUBROUTINE QSASC(LU,RACK,MODULE,
     1                                                   MODE,EFLAG)
                                        INTEGER LU,RACK,MODULE,MODE,EFLAG
C    /* ARGUMENT LIST VARIABLES: */
C    /* LU           LOGICAL UNIT NUMBER */
C    /* RACK         RACK NUMBER */
C    /* MODULE       MODULE NUMBER */
C    /* MODE         MODE NUMBER */
C    /* EFLAG        ERROR CODE */
C    DECLARE         MVFGCM  COMMON
C         1 IARRAY(512)  INTEGER
C         1 LUTBLE(3,N)  INTEGER
C         1 ENDTBL       INTEGER
                                        COMMON /MVFGCM/IARRAY(512),LUTBLE(3,1)
                                        INTEGER IARRAY,LUTBLE
C    /* COMMON       VARIABLES: */
C    /* IARRAY       ARRAY FOR BINARY DATA */
C    /* LUTBLE       LOGICAL UNIT TABLE -
C                   N IS THE LENGTH OF THE TABLE -
C                   AND IS SPECIFIED BY THE USER
C                   IN QSINC */
C    /* ENDTBL       END OF LOGICAL UNIT TABLE */
C    /* IN THE LOGICAL UNIT TABLE */
C    /* LUTBLE(1,-) IS THE LOGICAL UNIT NUMBER */
C    /* LUTBLE(2,-) HAS THE RACK/MODULE/MODE */
C    /*              =4096*RACK+512*MODULE+MODE */
C    /* LUTBLE(3,-) HAS X AND Y EXTENTS */
C    /* QSASC        SETS LUTBLE(1,-) AND LUTBLE(2,-) AND CLEARS LUTBLE(3,-) */
C
C C C C C C C C C C C C C C C C C C C C C C C C C C C C C C C C C C C C C C C
C
C    DECLARE MODNUM(4)   INTEGER
C         INITIALIZE (0,1,2,3)
C         /* IN MODNUM, THE INDEX IS THE MODE NUMBER; AND THE
C              VALUE IS THE HARDWARE MODE REGISTER VALUE.      */
C                                        MODE REGISTER VALUE
C
C                                        FORTRAN DATA TYPES
C
C
```

```
                                INTEGER BITNO
                                INTEGER DFWORD
                                INTEGER STATUS
                                INTEGER STSV
                                DIMENSION MODNUM(4)
C                               ADDRESS OF MODE REGISTER
                                DATA MODREG/15/
C                               MINIMUM AND MAXIMUM MODE
                                DATA MINMOD/1/,MAXMOD/4/
C                               MINIMUM AND MAXIMUM LENGTH
                                DATA MINLU/1/,MAXLU/32767/
C                               STATUS BIT FOR NO SUCH MODULE
                                DATA BITNO/0/
C                               STATUS WORD FOR SVFG
                                DATA STSV/1/
                                DATA MODNUM/0,1,2,3/
C
C C C
```

```
C
C C C
```

```
C         INITIALIZE(     COL1   2   3   4   5   6   7   8
C                    ROW1    1   3   5   7   9  11  13  15
C                        2   1   5   9  13   0   0   0   0
C                        3   1   3   5   9  11  13   0   0
C                        4   1   9   0   0   0   0   0   0
C    /* THE FIRST INDEX IS THE MODE, THE SECOND IS THE FUNCTION NUMBER, */
C    /* AND THE VALUE IS THE FIRST FUNCTION MEMORY NUMBER */
                                        DATA TBLFUN/1,1,1,1,3,5,3,0,5,9,5,0,
     1                                              7,13,9,0,9,0,11,0,11,0,
     2                                              13,0,13,0,0,0,15,0,0,0/
C                                       MINIMUM AND MAXIMUM MODE
                                        DATA MINMOD/1/,MAXMOD/4/
C                                       MINIMUM AND MAXIMUM FUNCTION NUMBER
                                        DATA MINFUN/1/,MAXFUN/8/
C
                                        IF( EFLAG .NE. 1) GO TO 900
C         GET FIRST ARGUMENT MEMORY NUMBER FROM TBLARG;
                                        ARGMEM = TBLARG(MODE,FUNCNO)
C         IF(NOT A LEGAL MEMORY) THEN EFLAG = 17;
                                        IF( ARGMEM .EQ. 0) EFLAG = 17
C         GET FIRST FUNCTION MEMORY NUMBER;
                                        FUNMEM = TBLFUN(MODE, FUNCNO)
C         IF(NOT A LEGAL MEMORY) THEN EFLAG=17;
                                        IF(FUNMEM .EQ. 0) EFLAG = 17
C         END; /* THEN */
 900                                    CONTINUE
C    END; /* QSTRC */
                                        RETURN
                                        END
C    /* MVFG RTL FUNCTION TO RETURN THE MODE OF A LOGICAL UNIT */
C    /* IF LOGICAL UNIT NOT ASSIGNED, ZERO IS RETURNED */
C    DECLARE QCLUI FUNCTION ENTRY ((*) INTEGER)
C    PROCEDURE QCLUI (LU)
                                        INTEGER FUNCTION QCLUI(LU)
                                        INTEGER LU
C    /* ARGUMENT LIST VARIABLES; */
C    /* LU            LOGICAL UNIT */
C    /* QCLUI         MODE OF LU */
C    DECLARE         MVFGCM    COMMON
C         1 IARRAY(512)  INTEGER
C         1 LUTBLE(3,N)  INTEGER
C         1 ENDTBL       INTEGER
                                        COMMON /MVFGCM/IARRAY(512),LUTBLE(3,1)
                                        INTEGER LUTBLE,IARRAY
C    /* COMMON VARIABLES: */
C    /* IARRAY        ARRAY FOR BINARY DATA */
C    /* LUTBLE        LOGICAL UNIT TABLE */
C    /*               N IS THE LENGTH OF THE */
C    /*               TABLE AND IS SPECIFIED */
C    /*               BY THE USER IN QSINC */
C    /* ENDTBL        END OF LOGICAL UNIT */
C    /*               TABLE - INITIALIZED TO -1 */
C    /* LUTBLE (2,-) HAS THE RACK, MODULE, AND */
C    /*               MODE NUMBERS */
C    /* LUTBLE(2,-) = 4096*RACK+512*MODULE+MODE */
C
C C C C C C C C C C C C C C C C C C C C C C C C C C C C C C C C C C C C C C
C
C    BEGIN; /* QCLUI */
C
C    /* SEARCH LOGICAL UNIT TABLE */
                                        I=1
C    REPEAT;
 200                                    CONTINUE
C         GET LOGICAL UNIT TABLE ENTRY;
C    UNTIL (ENTRY MATCHES LU OR END OF ENTRIES OR END OF TABLE);
                                        IF(( LUTBLE(1,I) .EQ. LU) .OR.
     2                                     ( LUTBLE(1,I) .EQ. 0 ) .OR.
     2                                     ( LUTBLE(1,I) .EQ. -1)) GO TO 300
                                        I = I+ 1
                                        GO TO 200
 300                                    CONTINUE
```

```
C    IF (ENTRY MATCHES)
                                        IF(LUTBLE(1,I) .NE. LU) GO TO 350
C          THEN QCLUI EQUALS THE MODE;
                                        QCLUI=LUTBLE(2,I)*
     1                                        (LUTBLE(2,I)/512)*512
                                        GO TO 399
C          ELSE QCLUI EQUALS ZERO;
 350                                    CONTINUE
                                        QCLUI = 0
 399                                    CONTINUE
C    END; /* QCLUI */

                                          RETURN
                                          END
```

What is claimed is:

1. A variable analog function generator independent of external data source and control during time of generation of at least one predetermined output function of at least one input variable with said output function expressed in terms of hybrid variables each having an analog portion and a digital portion comprising first dedicated memory means having stored therein data related to breakpoints defining the input variable, second dedicated memory means having stored therein tables of values defining said digital portion, means for generating said analog portions independent of said external data source and control in response to (1) the input variable and (2) said data related to the breakpoints accessed in parallel from said first dedicated memory means, and, means for generating said output function independent of said external data source and control in response to (1) said analog portions and (2) said tables of values accessed from said second dedicated memory means.

2. A variable analog function generator independent of external data source and control during time of generation of at least one predetermined output function of at least one input variable with said output function expressed in terms of hybrid variables each having an analog portion and a digital portion comprising first dedicated memory means having stored therein breakpoints and first differences defining the input variable, second dedicated memory means having stored therein tables of values defining said digital portion, means for generating said analog portions independent of said external data source and control in response to (1) the input variable and (2) said breakpoints and said first differences accessed in parallel from said first dedicated memory means, and, means for generating said output function independent of said external data source and control in response to (1) said analog portions and (2) said tables of values accessed from said second dedicated memory means.

3. The generator of claim 2 in which there is provided an associated analog portions generator means and first dedicated memory means for each of a plurality of input variables, and a plurality of output function generator means each having associated second dedicated memory means.

4. The generator of claim 3 in which there is provided means for controlling the simultaneous and parallel accessing of said breakpoints and first differences from each of said first dedicated memory means.

5. The generator of claim 3 in which said controlling means includes means for accessing all of said second dedicated memory means simultaneously and all in parallel.

6. The generator of claim 2 in which there is provided means for controlling (1) the sequence of loading during set up time said first dedicated memory means from said data source with said breakpoints and first differences and said second dedicated memory means with said tables of values, and (2) the sequence of accessing said breakpoints and first differences and said tables of values loaded in said first and second dedicated memory means during function generation time and independent of said external data source and control.

7. The generator of claim 6 in which there is provided an associated analog portions generator means and first dedicated memory means for each of a plurality of input variables, and said controlling means including means for respectively sequencing the loading during set up time from said data source the respective breakpoints and first differences into an associated first dedicated memory.

8. The generator of claim 7 in which there is provided a plurality of output function generator means each having an associated second dedicated memory means, extent means under the control of said controlling means and a selected output function generator means for updating in parallel the table of values in the associated second memory means in accordance with the number of breakpoints in a selected first memory means during said function generation time.

9. The generator of claim 8 in which said controlling means includes third dedicated memory means for receiving from said data source during set up time factors related to said updating of the table of values loaded in said plurality of second memory means.

10. The generator of claim 9 in which said plurality of output function generator means includes a plurality of weighting function means for producing sets of weighting functions from each of said analog portions, each of said output function generator means including an associated multiplying means, each multiplying means being connected to an associated weighting function means for multiplying during function generation time and independent of said external data source and control predetermined sets of weighting functions by their associated stored tables of values to produce in parallel sets of product signals, and means for adding predetermined sets of product signals to generate said output function.

11. The generator of claim 2 in which said analog portions generating means includes means for comparing during function generation time and independent of said external data source and control the input variable with the breakpoints and first differences accessed in parallel from said first dedicated memory means.

12. The generator of claim 11 in which said comparing means includes first summing means for comparing the input variable with the analog value of said breakpoints, switching means coupled between first and second summing means for alternately reversing the polarity of the output of said first summing means for providing a triangular waveshape at the output of said second summing means.

13. The generator of claim 12 in which said comparing means includes means for multiplyng the output of said second summing means and the digital value of said first differences for producing a signal for application to an input of said second summing means, and means for detecting when the output of said second summing means crosses a 1 or a 0 thereby to switch said switching means and to incrementally access said first dedicated memory means.

14. A variable analog function generator independent of external data source and control during time of generation of a predetermined output function of at least one input variable with aid output functon being expressed in terms of hybrid variables each having an analog portion and a digital portion and receiving from said data source during set up time (1) breakpoints and first differences defining the input variable and (2) tables of values defining the digital portion comprising analog portions generation means including first dedicated memory means for receiving from said data source and loading only during set up time the breakpoints and first differences of the input variable, output function generating means including second dedicated memory means for receiving from said data source and storing only during set up time the tables of values of the digital portions, said analog portions generating means including means for comparing during function generation time and independent of said external data source and control the input variable with the breakpoints and first differences accessed in parallel from said first dedicated memory means for generating analog portions of the hybrid variable, means for producing sets of weighting function from said generated analog portions, and said output function generating means including means for multiplying during function generation time and independent of said external data source and control sets of weighting functions by their associated stored tables of values of the digital portions to produce sets of product signals and means for adding predetermined sets of product signals to generate said output function.

15. The generator of claim 14 in which there is provided means for controlling (1) the sequence of said loading of said first and second dedicated memory means during set up time and (2) the sequence of accessing in parallel said breakpoints and first differences and said tables of values stored respectively in first and second dedicated memory means during function generation time.

16. The generator of claim 14 in which there is provided an associated analog portions generator means and first dedicated memory means for each of a plurality of input variables, and a plurality of output functon generator means each having associated second dedicated memory means, and means for controlling the simultaneous and parallel accessing of said breakpoints and first differences from each of said first dedicated memory means.

17. The generator of claim 16 in which said controlling means includes means for accessing all of said second dedicated memory means simultaneously and all in parallel.

18. The generator of claim 14 in which there is provided means for controlling (1) the sequence of loading during set up time said first dedicated memory means from said data source with said breakpoints and first differences and said second dedicated memory means with said tables of values, and (2) the sequence of accessing said breakpoints and first differences and said tables of values loaded in said first and second dedicated memory means during function generation time and independent of said external data source and control.

19. The generator of claim 18 in which there is provided an associated analog portions generator means and first dedicated memory means for each of a plurality of input variables, and said controlling means including means for respectively sequencing the loading during set up time from said data source the respective breakpoints and first differences into an associated first dedicated memory.

20. The generator of claim 19 in which there is provided a plurality of output function generator means each having an associated second dedicated memory means, extent means under the control of said controlling means and a selected output function generator means for updating in parallel the table of values in the associated second memory means in accordance with the number of breakpoints in a selected first memory means during said function generation time.

21. The generator of claim 20 in which said controlling means includes third dedicated memory means for receiving from said data source during set up time factors related to said updating of the table of values loaded in said plurality of second memory means.

22. The generator of claim 21 in which said plurality of output function generator means includes a plurality of weighting function means for producing sets of weighting functions from each of said analog portions, each of said output function generator means including as associated multiplying means, each multiplying means being connected to an associated weighting function means for multiplying during function generation time and independent of said external data source and control predetermined sets of weighting functions by their associated stored tables of values to produce in parallel sets of product signals, and means for adding predetermined sets of product signals to generate said output function.

23. The generator of claim 14 in which said comparing means includes first and second summing means, said first summing means for comparing the input variable with the analog value of said breakpoints, switching means coupled between said first and second summing means for alternately reversing the polarity of the output of said first summing means for providing a triangular waveshape at the output of second summing means.

24. The generator of claim 23 in which said comparing means includes means for multiplying the output of said second summing means and the digital value of said first differences and applying the product to an input of said second summing means, means for detecting when the output of said second summing means crosses a 1 or a 0 thereby to switch said switching means and to incrementally access said first dedicated memory means.

* * * * *